US010173430B2

(12) United States Patent
Urabe et al.

(10) Patent No.: US 10,173,430 B2
(45) Date of Patent: Jan. 8, 2019

(54) PRINTING APPARATUS AND CONTROL METHOD

(71) Applicant: SEIKO EPSON CORPORATION, Tokyo (JP)

(72) Inventors: Yuichi Urabe, Shiojiri (JP); Kazushi Arafuka, Matsumoto (JP); Ken Inoue, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/787,086

(22) Filed: Oct. 18, 2017

(65) Prior Publication Data

US 2018/0111375 A1 Apr. 26, 2018

(30) Foreign Application Priority Data

Oct. 21, 2016 (JP) ..... 2016-206822
Oct. 21, 2016 (JP) ..... 2016-206823

(51) Int. Cl.
*B41J 2/165* (2006.01)

(52) U.S. Cl.
CPC ..... *B41J 2/16538* (2013.01); *B41J 2/16541* (2013.01); *B41J 2/16544* (2013.01)

(58) Field of Classification Search
CPC ..... B41J 2/16538; B41J 2/16541; B41J 2/16544; B41J 2/16523; B41J 2/16535; B41J 2/16547
USPC ..... 347/20, 22, 33
See application file for complete search history.

(56) References Cited

U.S. PATENT DOCUMENTS

| | | | | |
|---|---|---|---|---|
| 5,980,018 | A * | 11/1999 | Taylor | B41J 2/16547 347/31 |
| 9,168,754 | B2 * | 10/2015 | Mano | B41J 2/16538 |
| 9,186,899 | B2 * | 11/2015 | Ogata | B41J 2/16541 |
| 2007/0103505 | A1 | 5/2007 | Takagi | |
| 2008/0024550 | A1 | 1/2008 | Miyazawa | |
| 2010/0207994 | A1 | 8/2010 | Hayashi | |

FOREIGN PATENT DOCUMENTS

| | | | |
|---|---|---|---|
| JP | 2007-152940 | A | 6/2007 |
| JP | 5481772 | B | 11/2007 |
| JP | 2010-188565 | A | 9/2010 |
| JP | 2015-231721 | A | 12/2015 |

* cited by examiner

*Primary Examiner* — An Do
(74) *Attorney, Agent, or Firm* — Workman Nydegger

(57) ABSTRACT

There is provided a printing apparatus which performs printing by ejecting ink from a nozzle, including: a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, in which the wiper blade includes a blade member which protrudes in a second direction which is substantially orthogonal to the first direction, and in which the cleaner includes a scraping member which protrudes in a third direction which is a direction opposite to the second direction.

6 Claims, 23 Drawing Sheets

PRINTING APPARATUS AND CONTROL METHOD

BACKGROUND

1. Technical Field

The present invention relates to an ink jet type printing apparatus including a mechanism for wiping a nozzle surface, and more particularly to a printing apparatus that can appropriately prevent an apparatus from ink scattering when ink adhering to a wiper blade is scraped off without an increase in size and complexity of the apparatus.

2. Related Art

In the related art, an ink jet type printer is used widely. In such a printer, a print head includes a plurality of nozzles that discharge (eject) ink onto a print medium, but ink may adhere to the vicinity of a nozzle opening portion and be solidified. In such a state, there are problems that the ink ejection direction becoming unstable, ink ejection being impossible, and the like are generated.

Therefore, in the related art, a wiper made of a rubber plate or the like is provided to clean an ink ejecting surface (nozzle surface). In addition, after cleaning, cleaning for scraping off the ink adhering to the wiper is performed.

In JP-A-2007-152940, an apparatus for removing ink adhering to a rear surface of a wiper using an ink absorbing body is proposed.

However, a method described in JP-A-2007-152940 described above has a risk that ink absorbed by the ink absorbing body thickens and causes malfunction.

In addition, as another method, there is a method that can move a rubber plate of a wiper while abutting on a cleaner (scraping member) and scrape off the adhering ink, but in that case, there is a problem that ink is scattered when the wiper passes through the cleaner. In order to protect other portions from ink scattering, a cover is provided in all directions in a movement direction of the wiper, and in a backward path of the wiper, means is taken to provide a mechanism that does not abut on the cleaner, but in either case, it is not preferable because an increase in size and complexity of the apparatus are generated.

SUMMARY

An advantage of some aspects of the invention is to provide an ink jet type printing apparatus having a mechanism which wipes a nozzle surface, which can appropriately prevent the apparatus from ink scattering when ink adhering to a wiper blade is scraped off without an increase in size and complexity of the apparatus.

According to an aspect of the invention, there is provided a printing apparatus which performs printing by ejecting ink from a nozzle, including: a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, in which the wiper blade includes a blade member which protrudes in a second direction which is substantially orthogonal to the first direction, in which the cleaner includes a scraping member which protrudes in a third direction which is a direction opposite to the second direction, and in which shapes of a tip surface of the blade member in the second direction and a tip surface of the scraping member in the third direction are formed so that the blade member is sequentially separated from the scraping member from one end toward the other end thereof in a fourth direction which is substantially orthogonal to the first direction in the tip surface thereof when the wiper blade abuts on the cleaner and passes through the cleaner.

According to the aspect, since the blade member is sequentially separated from the scraping member in one direction, an ink scattering direction can regulate (control) when the wiper blade passes through the cleaner. Therefore, by appropriately designing the shapes of the tip surface of the blade member and the tip surface of the scraping member, a region where the ink is not desired to be scattered, such as a printing region can be reliably prevented from ink scattering. Therefore, the region where ink is not desired to be scattered can be reliably prevented from ink scattering without an increase in size and complexity of the printing apparatus.

According to another aspect of the invention, there is provided a printing apparatus which performs printing by ejecting ink from a nozzle, including: a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, in which the wiper blade includes a blade member which protrudes in a second direction which is substantially orthogonal to the first direction, in which the cleaner includes a scraping member which protrudes in a third direction which is a direction opposite to the second direction, and in which shapes of a tip surface of the blade member in the second direction and a tip surface of the scraping member in the third direction are formed so that a separation distance between the blade member and the scraping member in the first direction increases without decreasing or decreases without increasing from one end toward the other end thereof in a fourth direction which is substantially orthogonal to the first direction in the tip surface of the blade member.

According to the aspect, since the blade member is sequentially separated from the scraping member in one direction, an ink scattering direction can regulate (control) when the wiper blade passes through the cleaner. Therefore, by appropriately designing the shapes of the tip surface of the blade member and the tip surface of the scraping member, a region where the ink is not desired to be scattered, such as a printing region can be reliably prevented for ink scattering. Therefore, the region where ink is not desired to be scattered can be reliably prevented for ink scattering without an increase in size and complexity of the printing apparatus.

Further, in an embodiment of the invention, the tip surface of the blade member may include two inclined portions which are positioned at both ends thereof in the fourth direction and a horizontal portion which connects the inclined portions to each other and extends substantially along the fourth direction, the tip surface of the scraping member may include one inclined portion which is positioned from one end in the fourth direction and a horizontal portion which connects the inclined portion and the other end in the fourth direction to each other and extends substantially along the fourth direction, and one of the inclined portions of the blade member and the inclined portion of the scraping member may be disposed at substantially the same position in the first direction, and inclination angles of the two inclined portions of the blade member with respect to the fourth direction may be less than an inclination angle of the inclined portion of the scraping member with respect to the fourth direction.

According to still another aspect of the invention, there is provided a printing apparatus which performs printing by ejecting ink from a nozzle, including: a wiper blade that abuts on a nozzle surface on which an opening of the nozzle is formed, and moves in a first direction, and wipes the ink adhering to the nozzle surface; and a cleaner that abuts on the moving wiper blade and scrapes off the ink adhering to the wiper blade, in which the cleaner includes a scraping member which protrudes in a direction which is substantially orthogonal to the first direction, and in which inclination angles of a front and rear surfaces of the scraping member in the first direction with respect to a surface substantially orthogonal to a direction in which the scraping member protrudes are different from each other.

According to the aspect, by appropriately designing the inclination angle of the scraping member, an ink scattering amount in a forward path and a backward path of the wiper blade can be controlled. Specifically, ink scattering to the printing region can be prevented. Also, in the aspect, the region where ink is not desired to be scattered can be reliably prevented from ink scattering without an increase in size and complexity of the printing apparatus.

Further, in a preferred embodiment of the invention, the inclination angle in the first direction which is the inclination angle of the front surface of the scraping member may be larger than the inclination angle in the first direction which is the inclination angle of the rear surface of the scraping member.

According to the embodiment, the ink scattering amount can increase when the wiper blade passes through the cleaner in the first direction.

According to still another aspect of the invention, there is provided a printing apparatus which performs printing by ejecting ink from a nozzle, including: a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, in which the wiper blade includes a blade member which protrudes in a second direction which is substantially orthogonal to the first direction, in which the cleaner includes a scraping member which protrudes in a third direction which is a direction opposite to the second direction, and in which a front and rear surfaces of the scraping member in the first direction is formed so that the positions thereof in the third direction at which the blade member is separated from the scraping member are different from each other with respect to a passing direction when the wiper blade abuts on the cleaner and passes through the cleaner.

According to the aspect, by appropriately designing the shape of the scraping member, the ink scattering amount in the forward path and the backward path of the wiper blade can be controlled. Specifically, ink scattering to the printing region can be prevented. Also, in the aspect, the region where ink is not desired to be scattered can be reliably prevented from ink scattering without an increase in size and complexity of the printing apparatus.

According to still another aspect of the invention, there is provided a method for controlling a printing apparatus that performs printing by ejecting ink from a nozzle, the printing apparatus including a carriage that mounts a print head having the nozzle and moves, a wiper blade that abuts on a nozzle surface on which an opening of the nozzle is formed, and wipes the ink on the nozzle surface, and a cleaner that abuts on the wiper blade and removes the ink on the wiper blade when the wiper blade passes therethrough, the method comprising: moving the carriage to a predetermined position which covers the wiper blade when the wiper blade passes through the cleaner.

Further objects and features of the invention will become apparent from the embodiments of the invention to be described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
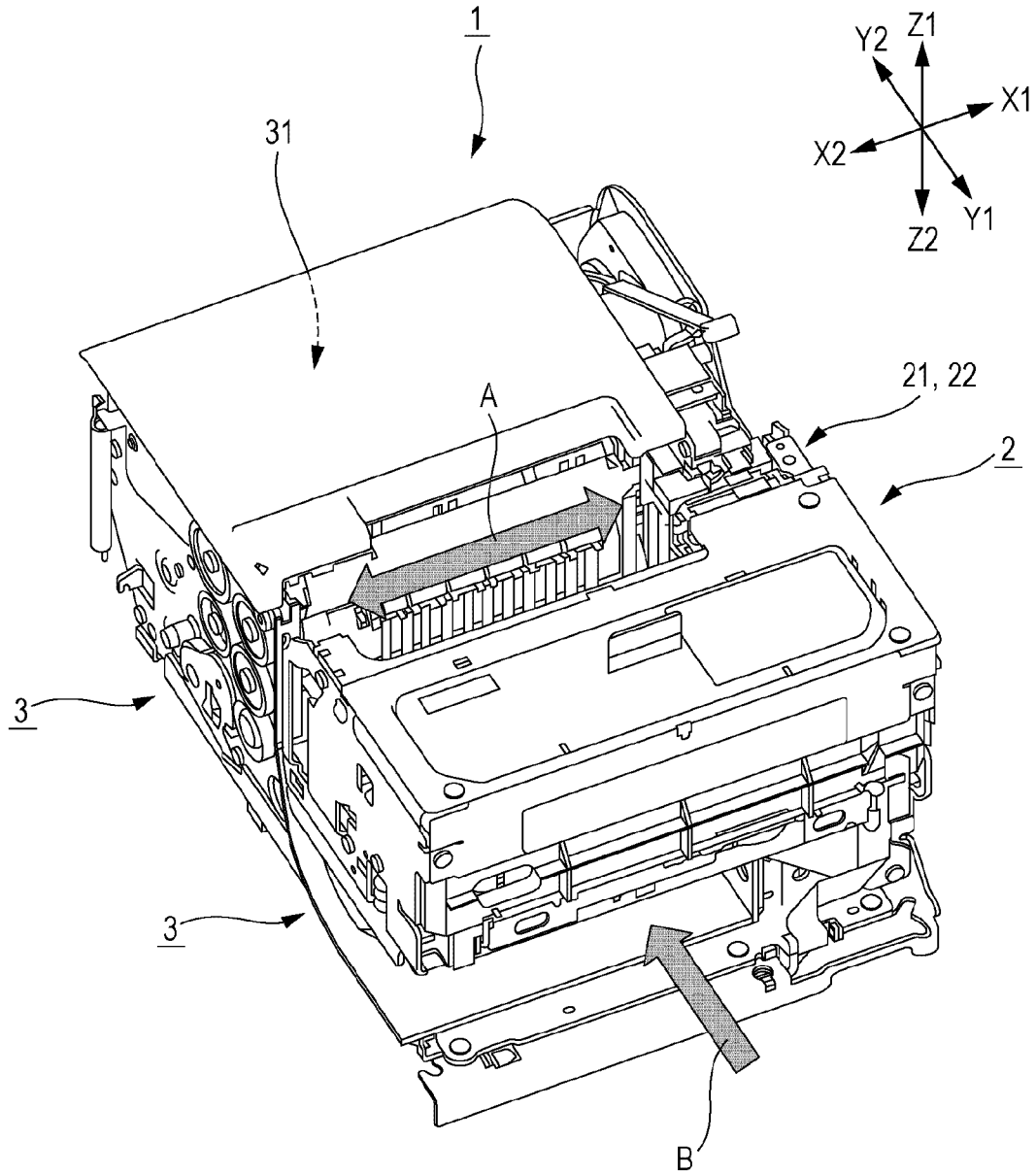
FIG. 1 is a perspective view according to an embodiment of a printing apparatus to which the invention is applied.

Hereinafter, embodiments of the invention will be described with reference to the drawings. However, such an embodiment does not limit the technical scope of the invention. In the drawings, the same or similar elements are described by being denoted the same reference numerals or reference symbols.

Figure 2:
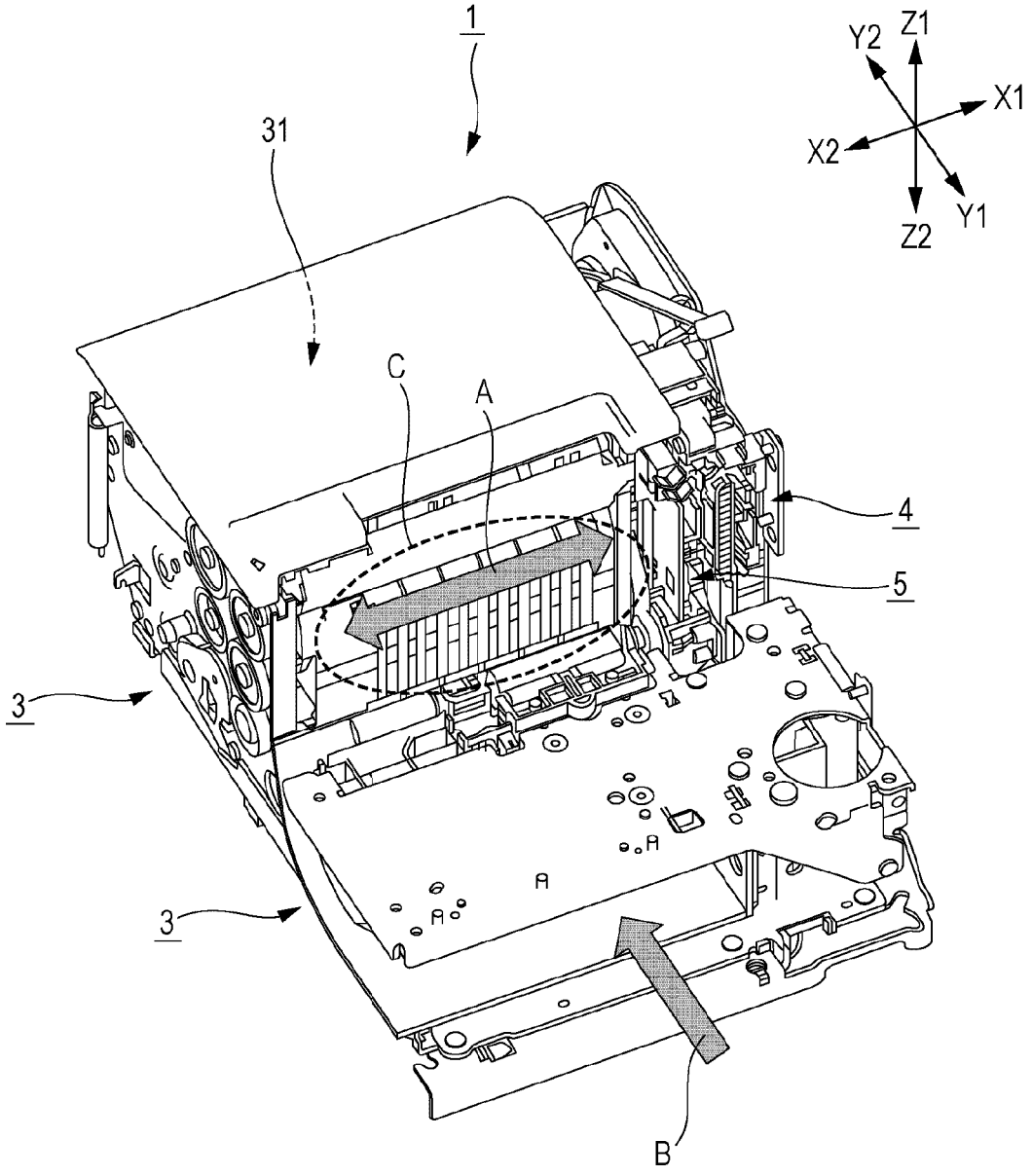
FIG. 2 is a perspective view according to an embodiment of the printing apparatus to which the invention is applied.

FIG. 1 and FIG. 2 are perspective views according to an embodiment of a printing apparatus to which the invention is applied. FIG. 1 illustrates an entire mechanism portion of an inside portion of a casing of the printing apparatus and FIG. 2 illustrates a portion in which a printing mechanism 2 and the like is excluded from the drawing illustrated in FIG. 1.

A printer 1 illustrated in FIG. 1 and FIG. 2 is the printing apparatus to which the invention is applied and the printer 1 includes a wiper unit 5 for cleaning a nozzle surface. The printer 1 is characterized by a shape of a wiper blade 51 and a cleaner 52 constituting the wiper unit, and according to shape thereof, an ink scattering direction and an ink scattering amount regulate (control) when a blade 51B of the wiper blade 51 passes through a scraping portion 52B of the cleaner 52. Accordingly, the apparatus can be appropriately prevented from ink scattering without increase in size and complexity of the apparatus.

The printer 1 is a so-called ink jet printer, as an example, a vertical type printer which can feed paper from two directions. The vertical type means that a nozzle surface is perpendicular to a ground surface of the printing apparatus, and in the present embodiment, a nozzle plate (nozzle surface) 222 to be described below is provided substantially perpendicular to the ground surface of the printer 1.

In the FIG. 1 and FIG. 2, a X direction illustrated by arrow X1-X2 indicates a left and right direction (X1: right direction, X2: left direction) in a case where the printer 1 is disposed on a horizontal ground surface, similarly, a Y direction illustrated by arrow Y1-Y2 indicates a front and rear direction (Y1: front direction, Y2: rear direction) in a case where the printer 1 is disposed on the horizontal ground surface, and similarly, a Z direction illustrated by arrow Z1-Z2 indicates an upward and downward direction (Z1: upward direction, Z2: downward direction) in a case where the printer 1 is disposed on the horizontal ground surface.

The printer 1 can insert a print medium (for example, paper such as check) from an outside portion of the apparatus in the direction of arrow B illustrated in FIG. 1 and FIG. 2, transport the print medium, and perform printing on the print medium. In addition, a roll-shaped print medium (for example, roll paper or the like) can be accommodated in the inside portion of the printer 1, and the print medium can be transported and the printing can be performed on the print medium. The roll-shaped print medium is accommodated in a paper accommodating portion 31 designated in FIG. 1 and FIG. 2 and thus the print medium is supplied in a direction opposite to arrow B (approximately in Y1 direction). In addition, a transport mechanism 3 is provided with respect to both of these printing media.

Figure 3:
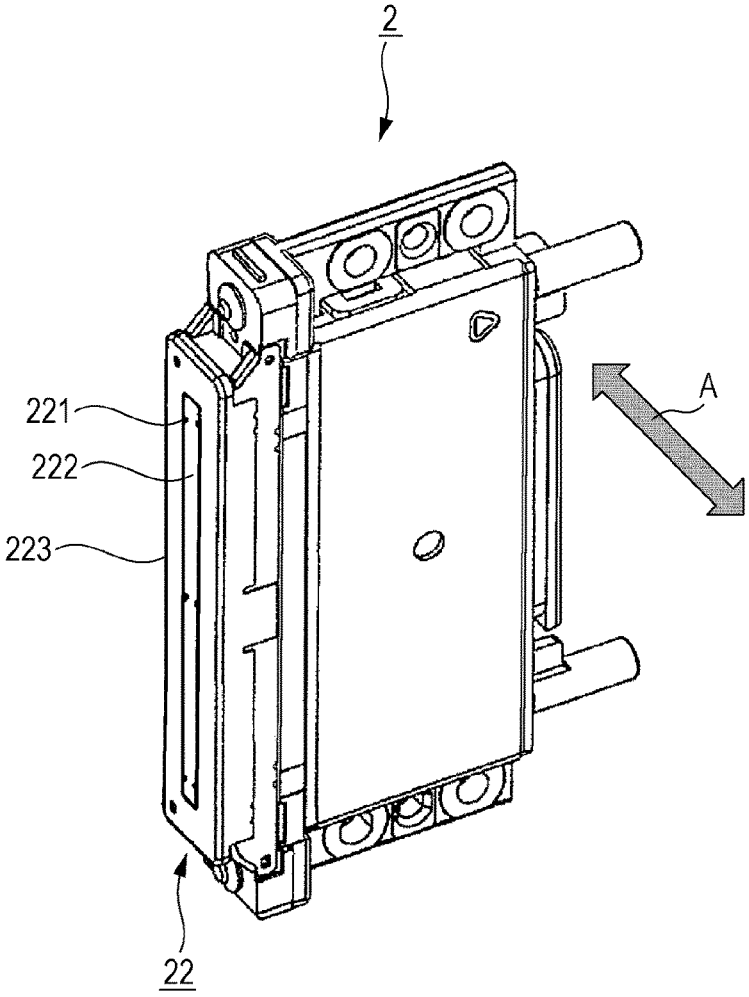
FIG. 3 is a perspective view of a print head.

In addition, the printer 1 includes a printing mechanism 2. The printing mechanism 2 is a portion that performs printing on the print medium which is transported by the transport mechanism 3 and includes a print head 22, a carriage 21, and the like. FIG. 3 is a perspective view of the print head 22.

Figure 20:
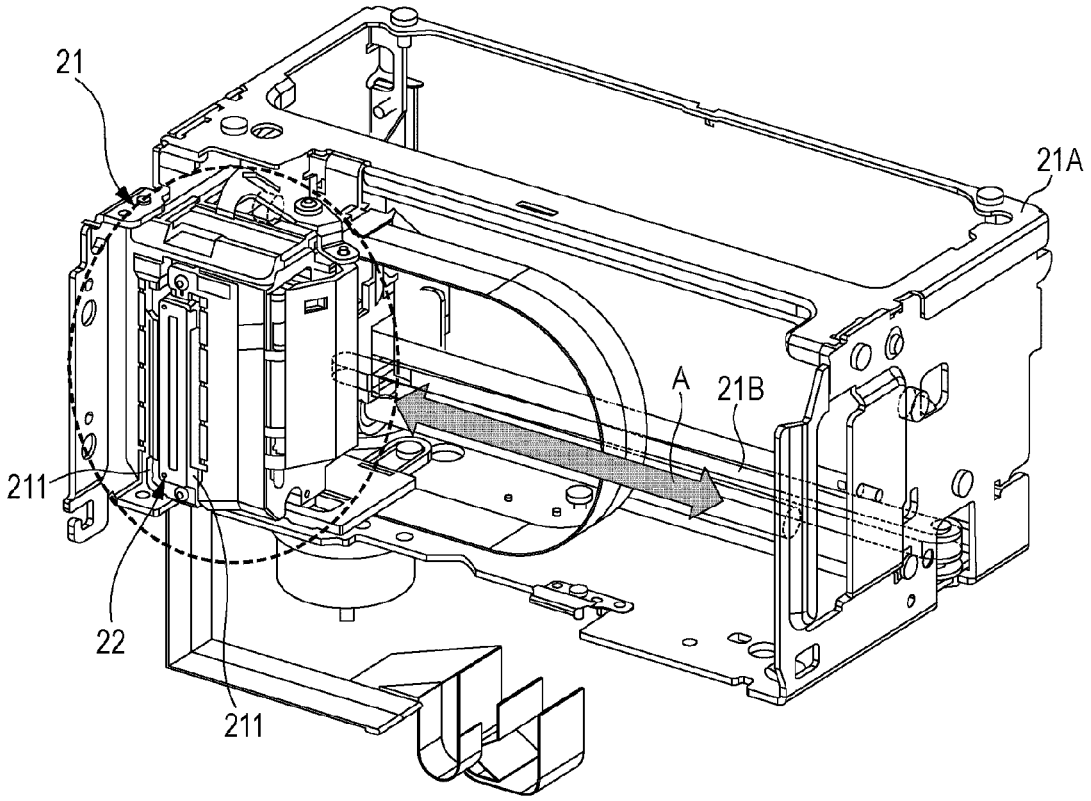
FIG. 20 is a perspective view of a periphery of a carriage.

The carriage 21 is a portion that mounts the print head 22 and moves the print head 22 in a scanning direction. As illustrated in FIG. 20, the carriage 21 is configured to be capable being reciprocated by a driving source (motor or the like) which is not illustrated, a transmission gear (belt 21B or the like) along a carriage frame 21A in the X direction (direction of arrow A in FIG. 1, FIG. 2 and FIG. 20).

The print head 22 includes a nozzle row 221 including a plurality of nozzles that discharge (eject) ink. In the present embodiment, as an example, two rows of nozzle rows 221 are provided. Each nozzle row 221 is provided along the Z direction. These nozzle rows 221 are formed by providing penetration holes in the nozzle plate 222. In addition, as illustrated in FIG. 3, the print head 22 includes a cover head 223 that surrounds the nozzle plate 222. The cover head 223 is formed of a plate-like member. Although the heights (position in Y direction) of front surfaces of the nozzle plate 222 and the cover head 223 (surface viewed in FIG. 3, surface facing Y2 direction, hereinafter referred to as nozzle surface) are approximately the same, here, the cover head 223 protrudes in the front direction (Y1 direction). In addition, although not illustrated, the print head 22 includes a mechanism for supplying ink to the nozzles in an inside portion thereof.

Although such a print head 22 moves by the carriage 21 and performs printing on the print medium supplied to a range (printing region C) indicated by C in FIG. 2, when printing is not performed and when maintenance is performed, the print head 22 moves to the position where a maintenance device (cap unit 4, wiper unit 5) is arranged in the X1 direction.

The printer 1 includes the cap unit 4 and the wiper unit 5 at the position illustrated in FIG. 2. The cap unit 4 is a device that covers the nozzle surface (nozzle discharge port, opening portion) and performs prevention of drying and suction of unnecessary ink at the discharge port of the nozzle.

The wiper unit 5 is a device for cleaning unnecessary ink on the nozzle surface (nozzle plate 222). The printer 1 is characterized by the wiper unit 5, and hereinafter, a configuration and an action thereof will be specifically described.

Figure 4:
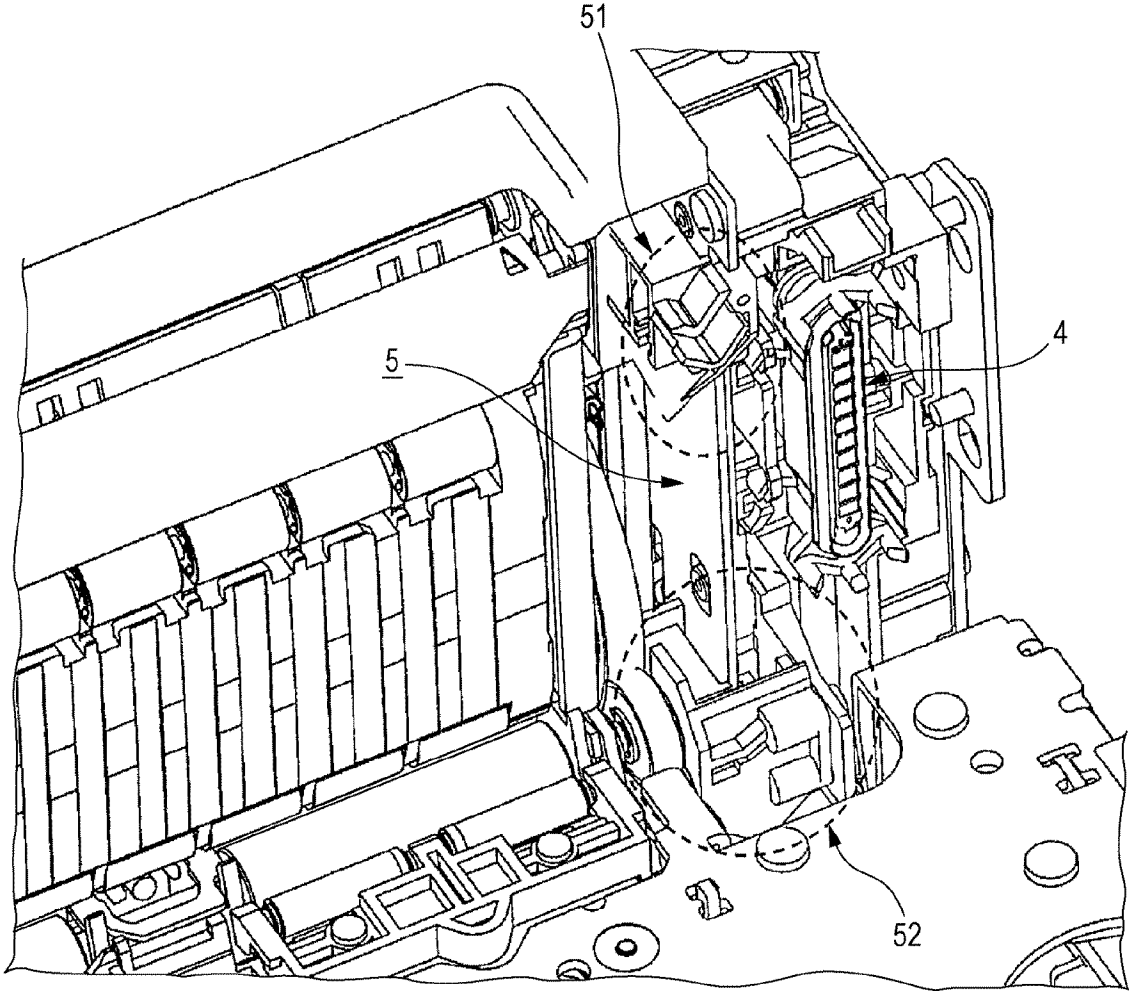
FIG. 4 is a perspective view illustrating a portion of a wiper unit.
Figure 5:
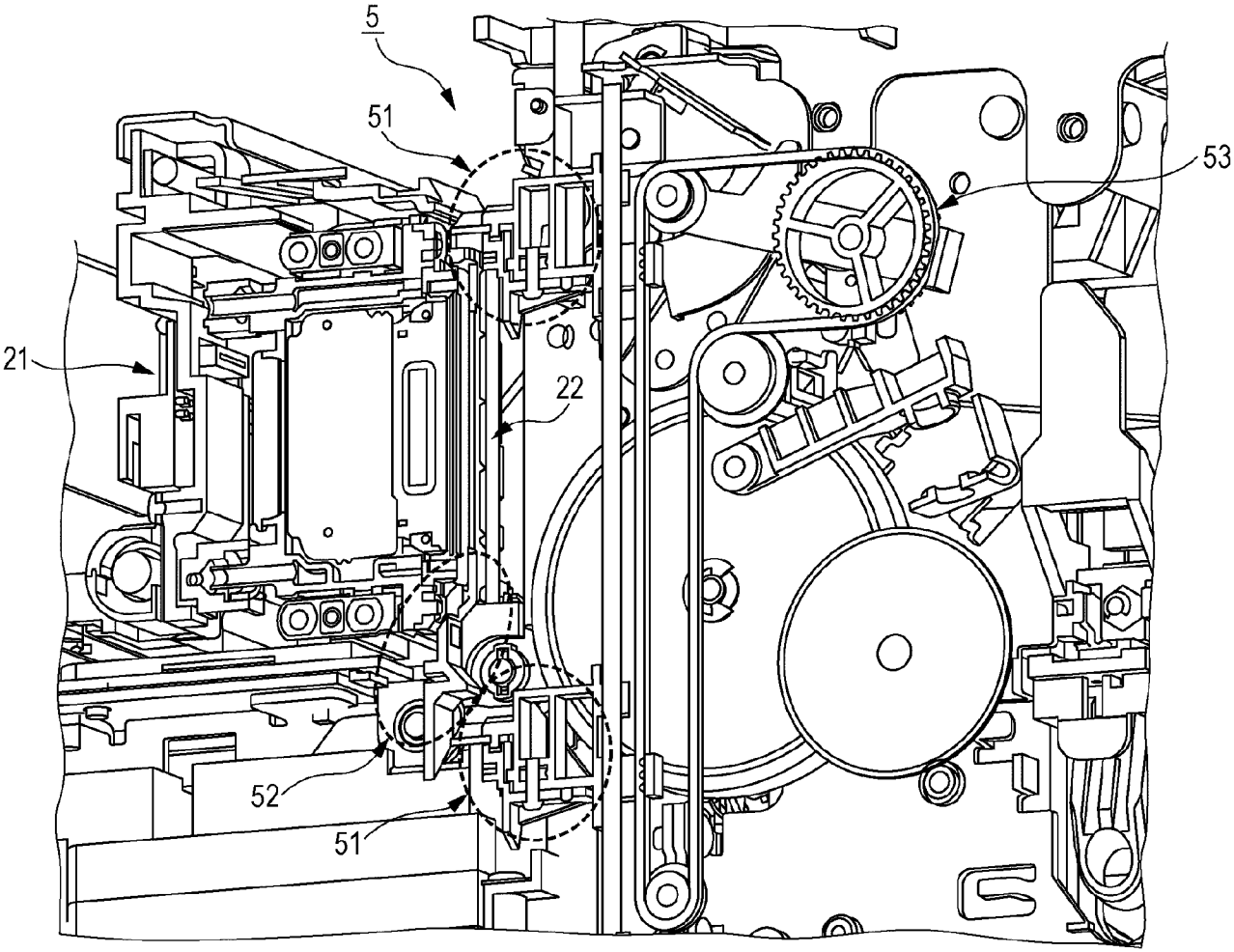
FIG. 5 is a perspective view illustrating a portion of the wiper unit.
Figure 6:
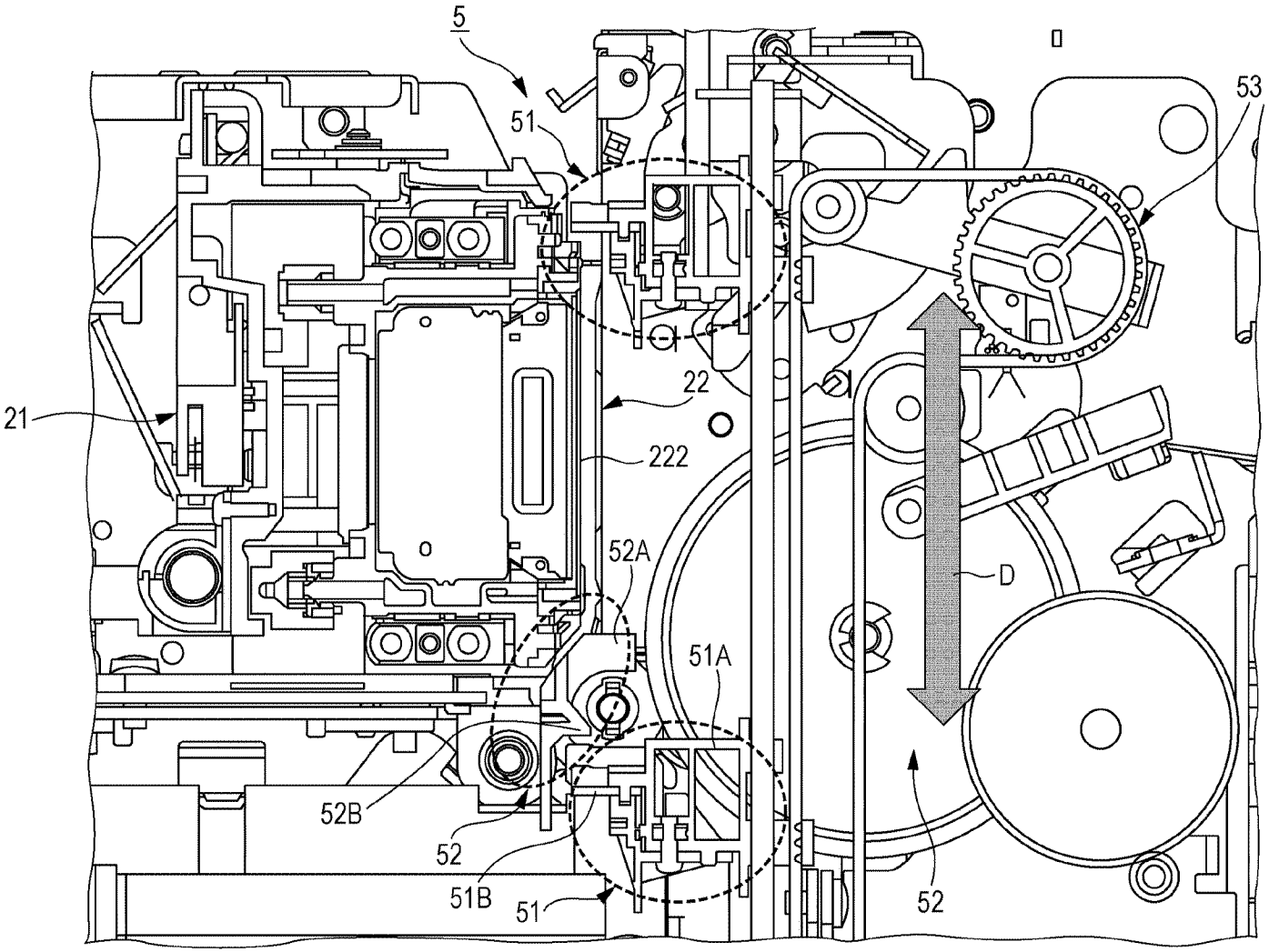
FIG. 6 is a side view illustrating a portion of the wiper unit.
Figure 7:
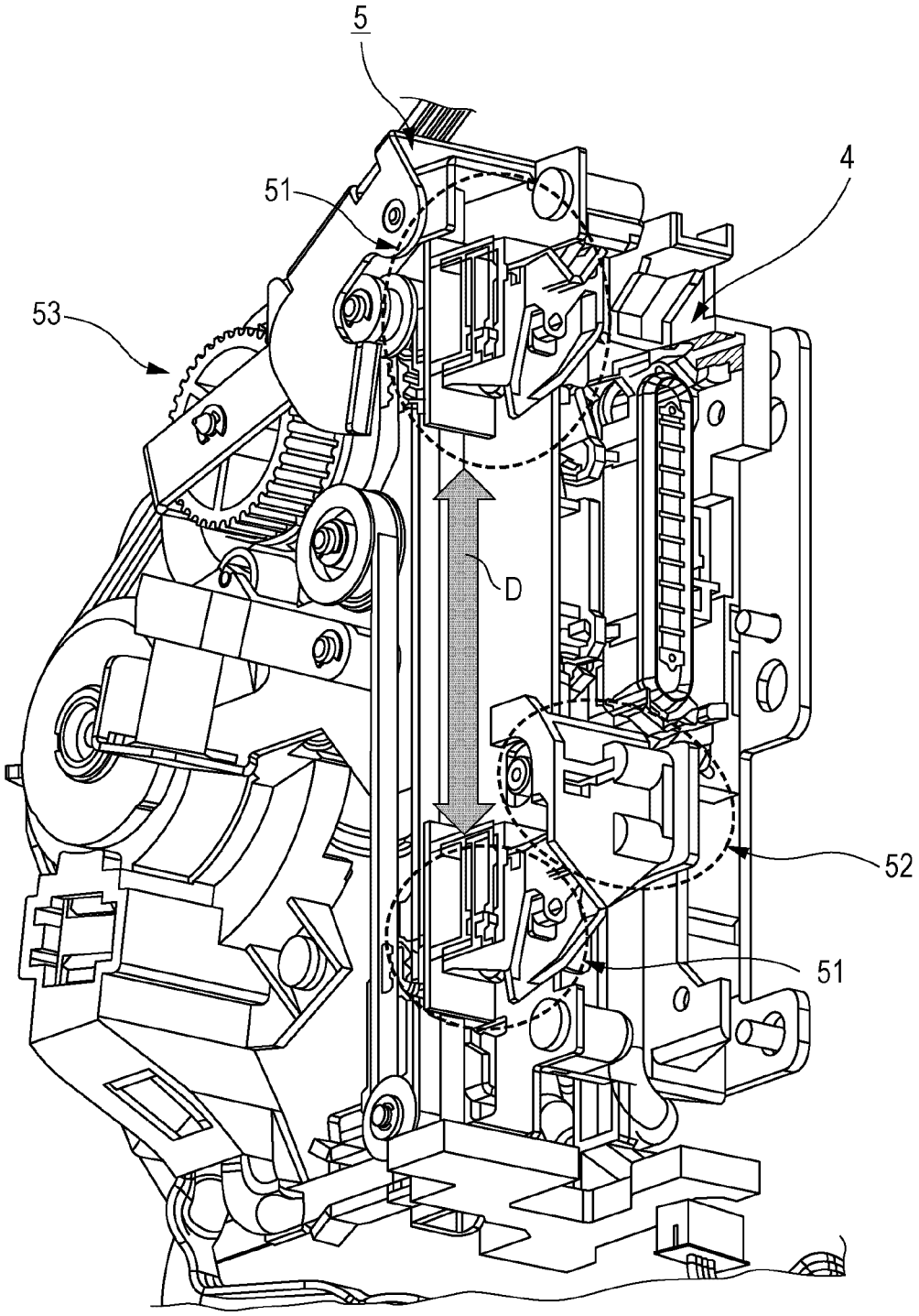
FIG. 7 is a perspective view illustrating a portion of the wiper unit.

FIG. 4, FIG. 5, and FIG. 7 are perspective views illustrating portions of the wiper unit 5, respectively. FIG. 6 is a side view illustrating a portion of the wiper unit 5. Both of a case where one wiper blade 51 is in the upper position (Z1 direction) and a case where one wiper blade 51 is in the lower position (Z2 direction) are illustrated in FIG. 5 to FIG. 7.

The wiper unit 5 includes a wiper blade 51, a cleaner 52, and a driving mechanism 53.

The driving mechanism 53 is a mechanism for moving the wiper blade 51 along the nozzle plate (nozzle surface) 222 in the Z direction (direction of arrow D in FIG. 6 and FIG. 7) and includes a driving source such as a motor (not illustrated), a transmission gear (drive wheel, belt, or the like). In a case of cleaning the nozzle surface 222 where the nozzle opening is formed, the print head 22 is moved to the position of the wiper unit 5 in the X direction and the driving mechanism 53 moves the wiper blade 51 which is in the upward position (Z1 direction) to the downward position (Z2 direction).

The wiper blade 51 is a portion that moves while abutting on the nozzle plate (nozzle surface) 222 and wipes off ink that is adhering (remained) on the nozzle surface 222. FIG.

Figure 9:
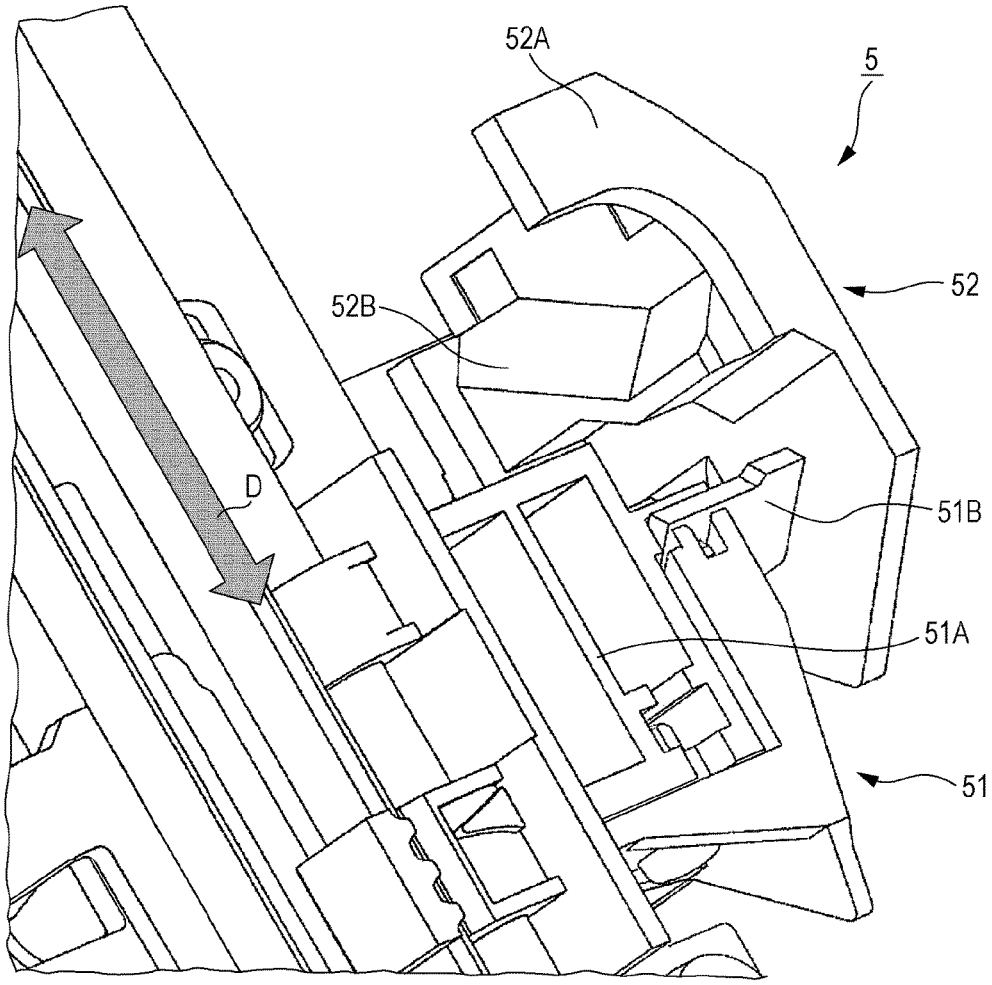
FIG. 9 is a perspective view illustrating a wiper blade and a cleaner.
Figure 10:
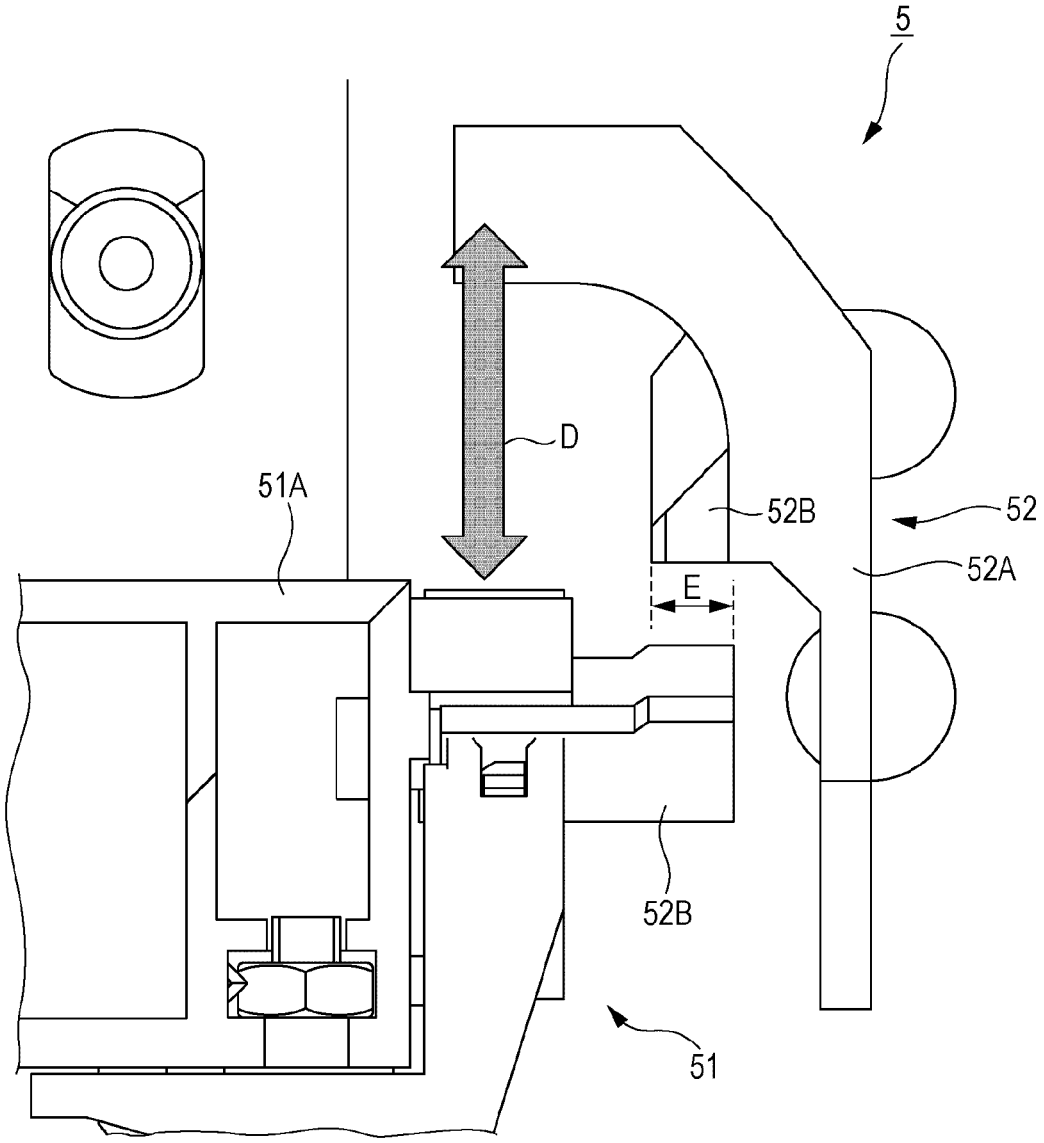
FIG. 10 is a side view illustrating the wiper blade and the cleaner.

8 is a perspective view illustrating a portion of the wiper blade 51. FIG. 9 is a perspective view illustrating the wiper blade 51 and the cleaner 52. FIG. 10 is a side view illustrating the wiper blade 51 and the cleaner 52.

As illustrated in FIG. 6 and FIG. 8 to FIG. 10, the wiper blade 51 includes a base portion 51A and the blade 51B (blade member). The base portion 51A is a portion that mounts the blade 51B and then is moved by the driving mechanism 53 described above.

The blade 51B is formed of a flexible material such as rubber and is attached to the base portion 51A so as to protrude from the base portion 51A in the Y1 direction. The blade 51B has a plate shape, an end surface (upper end surface, tip surface of protrusion) of the blade in the Y1 direction (second direction) and a sectional surface taken along a flat surface which is perpendicular in Y1 direction have a V shape (accurately, V shape with a bottom portion as illustrated in aa of FIG. 8). The blade 51B abuts on the nozzle surface 222 and wipes off the ink. Therefore, the length of the blade 51B (dimension in Y1 direction) is longer than an interval between the base portion 51A and the nozzle surface 222.

Figure 11:
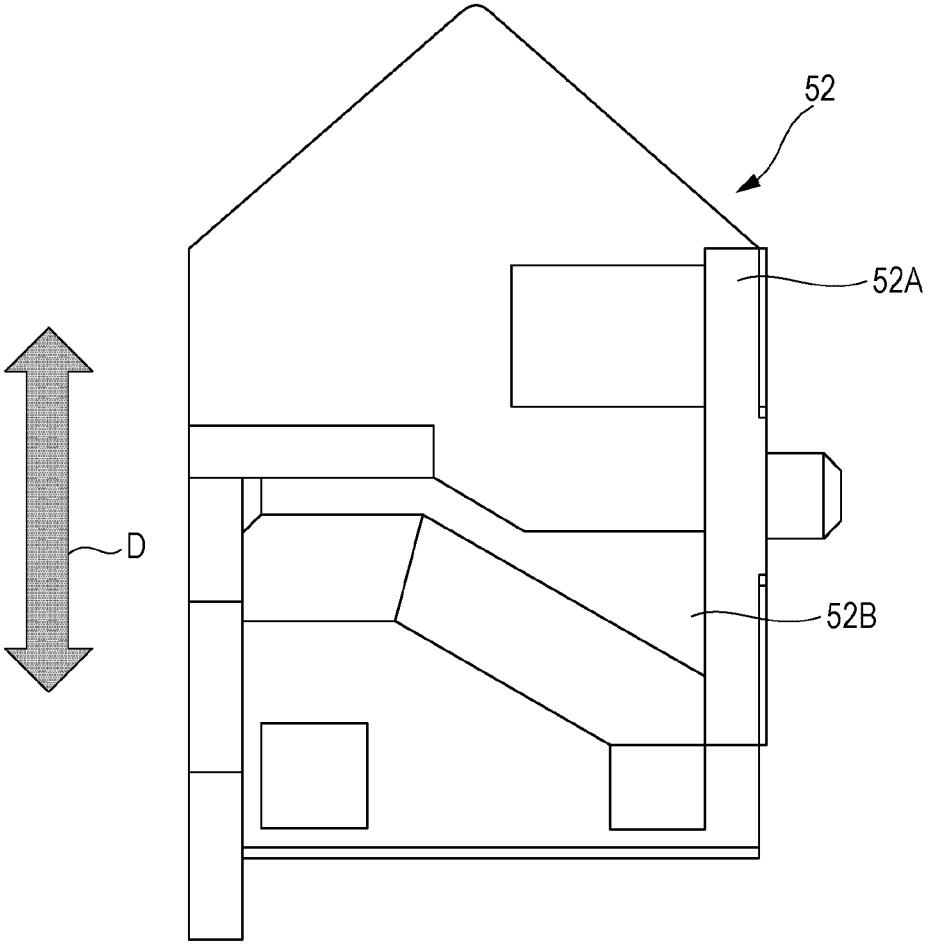
FIG. 11 is a view of the cleaner as viewed in a Y1 direction.

The cleaner 52 is a portion for removing the ink adhering to the wiping blade 51B by the blade 51B. As illustrated in FIG. 6 or the like, the cleaner 52 is in the lower portion (Z2 direction) on the moving track of the wiper blade 51 and is disposed (fixed) below the print head 22 (nozzle surface 222) in the Z2 direction. FIG. 11 is a view of the cleaner 52 as viewed in the Y1 direction.

As illustrated in FIG. 10 or the like, the cleaner 52 includes a frame 52A and a scraping portion 52B (a scraping member). The frame 52A is a member fixedly attached to a member constituting a framework of the printer 1.

The scraping portion 52B is a member that protrudes in the Y2 direction (third direction) from the frame 52A and is a portion that comes in contact (abut) with the blade 51B when the wiper blade 51 passes the position of the cleaner 52. Therefore, as illustrated in FIG. 10, the scraping portion 52B is positioned so as to overlap the blade 51B in the Y direction (E in FIG. 10). As illustrated in FIG. 9 and FIG. 11, the scraping portion 52B has a wall-like shape, which is characterized by the shape of the end surface thereof (end surface in Y2 direction, tip surface of protrusion).

The wiper unit 5 of the printer 1 configured as described above is characterized by shapes of the blade 51B of the wiper blade 51 and the scraping portion 52B of the cleaner 52 and hereinafter, the point thereof will be described.

First, the end surface (tip surface of protrusion, hereinafter referred to as aa surface) of the blade 51B in the Y1 direction and the end surface (tip surface of protrusion, hereinafter referred to as bb surface) of the scraping portion 52B in the Y2 direction are characterized by the shapes thereof. Specifically, at the time of a state where the blade 51B and the scraping portion 52B are separated from each other, a distance between the aa surface and the bb surface in the Z direction (direction of arrow D in FIG. 6 or the like), that is, a separation distance of the wiper blade 51 in a movement direction (first direction) has a shape of increasing without decreasing or decreasing without increasing sequentially from one end toward the other end of the aa surface in the X direction (fourth direction). In other words, the shapes of the aa surface and the bb surface are formed such that the aa surface is sequentially separated from the bb surface from one end toward the other end of the aa surface in the X direction. More correctly, the separation distance is the distance between the rear end of the aa surface in the movement direction of the wiper blade 51 and the tip of the bb surface in the movement direction of the wiper blade 51.

Figure 12:
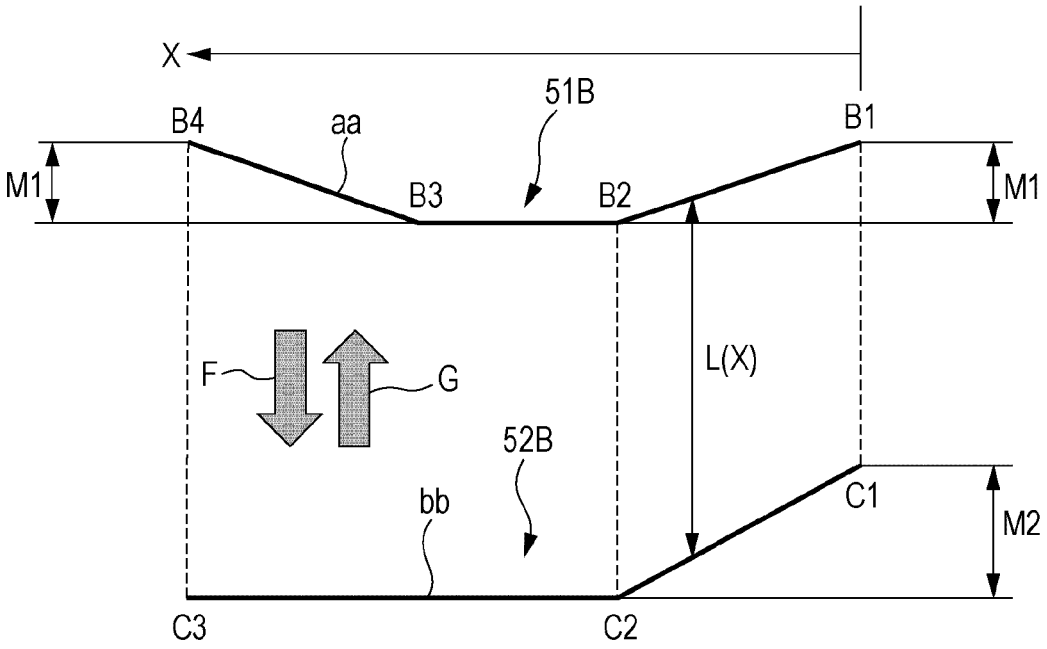
FIG. 12 is a schematic diagram for illustrating a separation distance between a blade and a scraping portion.

FIG. 12 is a schematic diagram for illustrating the separation distance. In FIG. 12, a direction indicated by arrow F is the Z2 direction and is a movement direction (forward path) when the wiper blade 51 wipes off ink on the nozzle surface 222, and a direction indicated by arrow G is the Z1 direction and is a direction (backward path) returning to a preparation position for wiping ink on the nozzle surface 222 by the wiper blade 51. In addition, in FIG. 12, the rear end (hereinafter, referred to as aa line) in the movement direction of the aa surface and the tip (hereinafter, referred to as bb line) of the bb surface in the movement direction of the aa surface are represented by lines.

As illustrated in FIG. 12, the aa line has an inclined portion (from B1 to B2 in X coordinates), a horizontal portion (from B2 to B3 in X coordinates), and an inclined portion (from B3 to B4 in X coordinates) in the X direction. On the other hand, the bb line has an inclined portion (from C1 to C2 in X coordinate) and a horizontal portion (from C2 to C3 in X coordinate) in the X direction. B1 and C1, B2 and C2, and B4 and C3 in the X coordinates have the same value (same position in X direction) respectively. In addition, the inclination of the inclined portion of the aa line with respect to the X direction is gentler than the inclination of the inclined portion of the bb line in the X direction. In other words, M1 and M2 in FIG. 12 have a relationship of $M1<M2$.

In FIG. 12, the separation distance between the blade 51B and the scraping portion 52B described above is represented by L (X). Then, in a range of from B1 to B4 in the direction of the X coordinate illustrated in FIG. 12, the value of L (X) increases sequentially without decreasing. In other words, at $B1 \leq X \leq B4$, $L'(X) \geq 0$. In other words, In other words, a change rate of the separation distance in the X direction is 0 or more.

Next, in the present wiper unit 5, the side surface of the scraping portion 52B of the cleaner 52 (side surface viewed from X direction, hereinafter referred to as cc surface) is characterized by the shapes thereof. Specifically, angles of sides of the generally trapezoidal cc surface facing in the Z direction (movement direction of wiper blade 51) are different from each other. In other words, the inclination angles of the scraping portion 52B with respect to surfaces perpendicular to the Y direction of the front and rear surfaces in the Z direction are different from each other.

Figure 13:
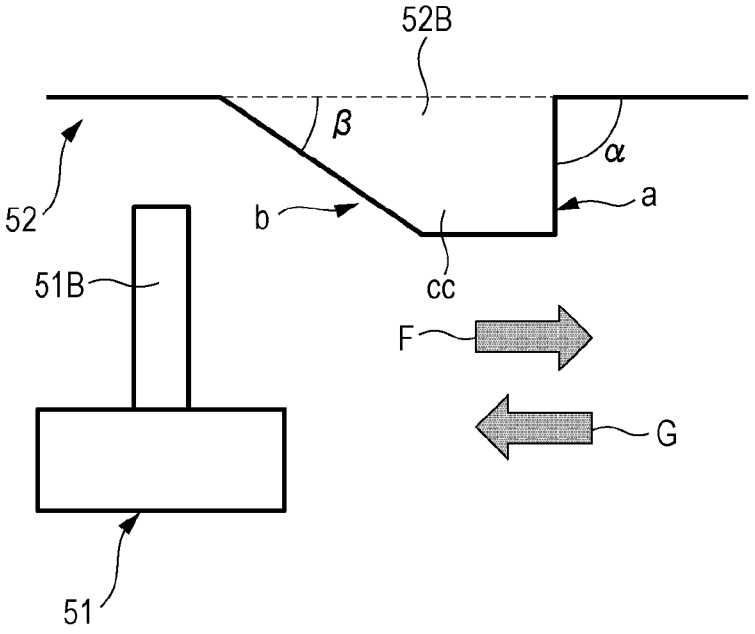
FIG. 13 is a schematic diagram for illustrating a side surface shape of the scraping portion.

FIG. 13 is a schematic diagram for illustrating the shape of the cc surface. In the present embodiment, the side (side illustrated in FIG. 13) of the cc surface in the Z2 direction (direction of arrow F in FIG. 13) forms nearly right angle with respect to the movement direction of the wiper blade 51, the angle $\alpha$ indicated in FIG. 13 is approximately 90 degrees. On the other hand, the side (side b illustrated in FIG. 13) of the cc surface in the Z1 direction (direction of arrow G in FIG. 13) is inclined with respect to the movement direction of the wiper blade 51, and the angle $\beta$ illustrated in FIG. 13 has a relationship of $\beta<\alpha$.

Next, an action of the shape of the wiper unit 5 described above will be described.

Figure 14:
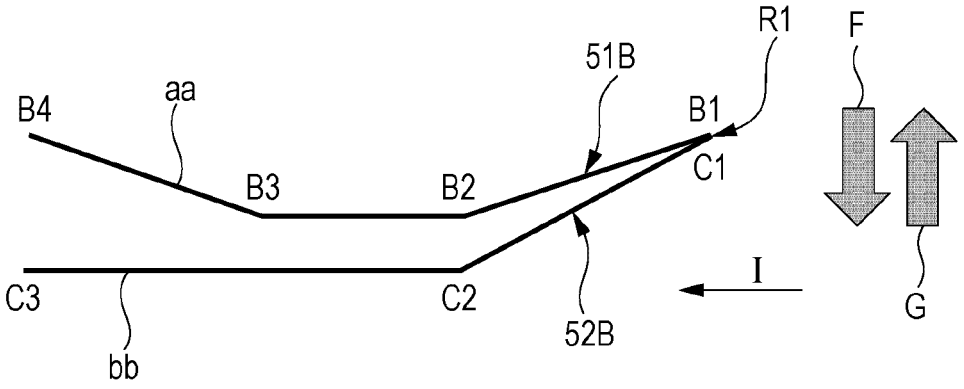
FIG. 14 is a diagram for illustrating an action by the shapes of an aa surface and a bb surface.
Figure 15:
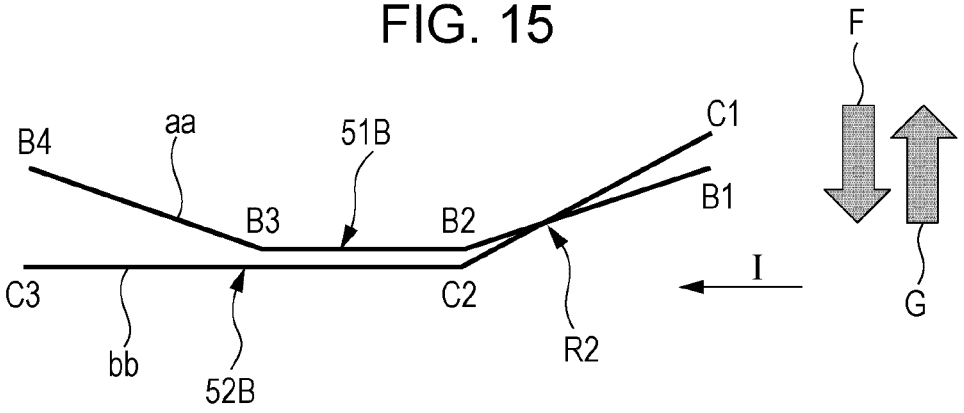
FIG. 15 is a diagram for illustrating the action by the shapes of the aa surface and the bb surface.
Figure 16:
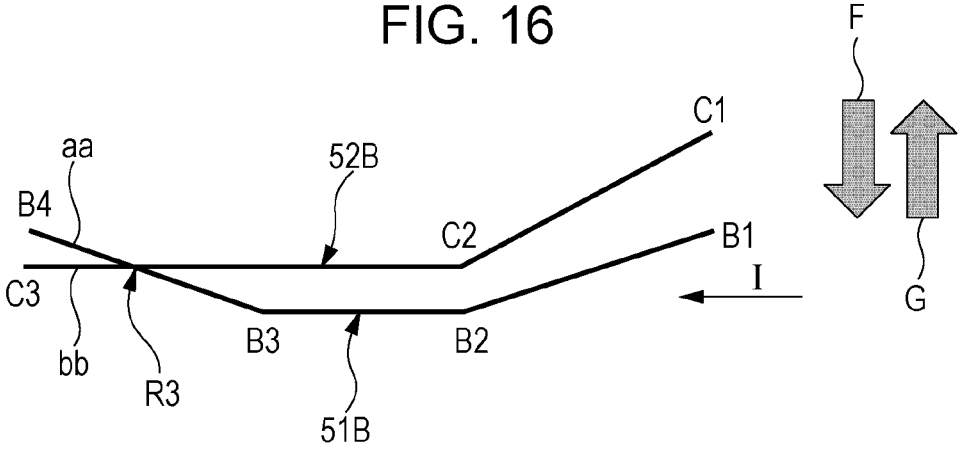
FIG. 16 is a diagram for illustrating the action by the shapes of the aa surface and the bb surface.

FIG. 14, FIG. 15, and FIG. 16 are diagrams for illustrating actions due to the shapes of the aa surface and the bb surface described above. FIG. 14 to FIG. 16 illustrate a transition when the blade 51B which has the aa surface (aa line) described with reference to FIG. 12 abuts on the scraping portion 52B which is forward path (moves in direction of arrow F in FIG. 12 or the like) and has the bb surface described with reference to the FIG. 12 and passes therethrough.

FIG. 14 illustrates a state where the blade 51B which is separated in the Z1 direction approaches and abuts on the scraping portion 52B and the portion of B1 having the shortest separation distance L (X) described above passes through the scraping portion 52B, that is, a state where a portion of B1 of the blade 51B is separated (released) from the scraping portion 52B.

Accordingly, when the blade 51B moves in the forward path, first, the blade 51B passes through the scraping portion 52B from the right end (end in X1 direction) of the aa surface (aa line).

Thereafter, the blade sequentially passes through the scraping portion 52B in the X2 direction due to the change of L (X) described above. FIG. 15 illustrates a state where the blade is passed through up to the middle of the inclined portion between B1 and B2 (up to point of R2).

FIG. 16 illustrates a state where the movement thereof further progresses and the blade passes through up to the middle of the inclined portion between B3 and B4 (up to point of R3).

Thereafter, as the movement progresses, the portion of B4 passes and the blade 51B entirely passes through the scraping portion 52B.

Accordingly, when the blade 51B passes through the scraping portion 52B, depending on a shape of the tip surfaces (aa surface and bb surface) of the blade 51B and the scraping portion 52B, the blade 51B sequentially is separated from the scraping portion 52B from the one end toward the other end thereof in the X direction (in direction of arrow I in FIG. 14 or the like). Therefore, when the ink remaining on the blade 51B is separated from the scraping portion 52B, the scattering direction can be regulated (narrowed) in a predetermined direction.

Figure 17:
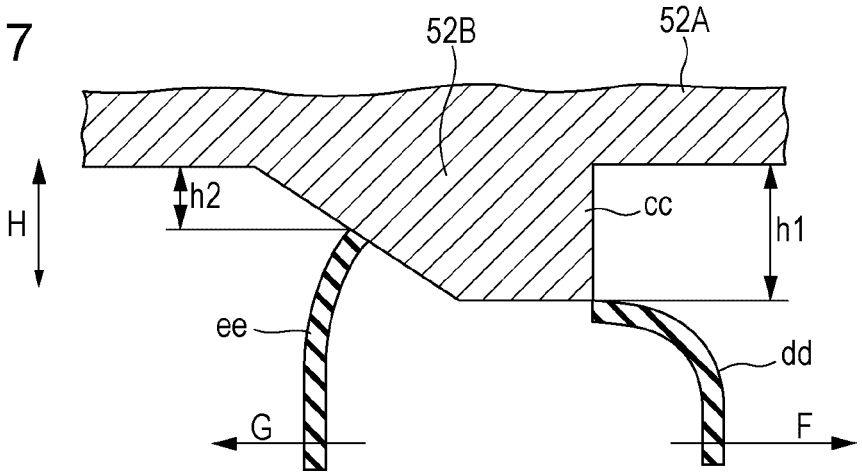
FIG. 17 is a diagram for illustrating the action by the side surface shape of the scraping portion.

Next, the action by the shape of the side surface (cc surface) of the scraping portion 52B described above will be described. FIG. 17 is a diagram for illustrating the action by the side surface shape of the scraping portion 52B. In FIG. 17, a side surface shape or the like of the scraping portion 52B described with reference to FIG. 13 is illustrated as a side view as viewed from the X direction.

The portion indicated by dd in FIG. 17 illustrates a state of immediately before the blade 51B moving in the forward path (in direction of arrow F in FIG. 17) is separated from the scraping portion 52B. In this case, when the blade 51B passes through the scraping portion 52B, the blade 51B returns to an original shape thereof from a point of height (length in Y2 direction) h1 from the frame 52A of the cleaner 52.

On the other hand, the portion indicated by ee in FIG. 17 illustrates a state of immediately before the blade 51B moving in the backward path (in direction of arrow G in FIG. 17) is separated from the scraping portion 52B. In this case, when the blade 51B passes through the scraping portion 52B, the blade 51B returns to an original shape thereof from the point of the height (the length in the Y2 direction) h2 from the frame 52A of the cleaner 52.

If comparing behaviors of when the blade 51B is returned to the original shape thereof in both cases described above, in a case of the former (forward path), amplitude thereof is large and swing speed thereof is also fast. Therefore, in the former case, more ink is taken out from the blade 51B and is scattered. Accordingly, depending on the shape of the side surface (cc surface) of the scraping portion 52B, more specifically, depending on the angle of the side of the side surface facing in the Z direction the ink scattering amount from the blade 51B can be controlled. In a case of the present embodiment illustrated in FIG. 13 and FIG. 17, the ink scattering amount in the forward path is increased, and the ink scattering amount in the backward path which has a possibility of flying in the direction of the printing region C is suppressed.

The shapes of the tip surfaces (aa surface and bb surface) of the blade 51B and scraping portion 52B and the shape of the side surface shape (cc surface) of the scraping portion 52B are not limited to the shapes illustrated in FIG. 12 and FIG. 13, and other shapes may be used as long as the shapes can exert the action described above. In other words, it suffices as long as the aa surface and the bb surface have a shape that the aa surface is sequentially separated from the bb surface from one end to the other end of the aa surface in the X direction. In addition, it suffices as long as the shapes of the aa surface and the bb surface have shapes that the separation distance therebetween in the movement direction of the wiper blade 51 increases without decreasing or decreases without increasing from the one end toward the other end of the aa surface in the X direction sequentially. More accurately, it suffices that as long as the shapes of the aa surface and the bb surface have shapes that the separation distance continues to increase from one end toward the other end of the aa surface in the X direction or the separation distance continues to increase including a portion where the separation distance is not partially changed. Alternatively, it suffices that as long as the shapes of the aa surface and the bb surface have shapes that the separation distance continues to decrease from one end toward the other end of the aa surface in the X direction or the separation distance continues to decrease including a portion where the separation distance is not partially changed. In other words, it suffices as long as the value of the change rate L'(X) of the separation distance L (X) in the X direction illustrated in FIG. 12 has a shape of L' (X)>0 from one end to the other end of the aa surface in the X direction or L'(X)=0 in a portion thereof and L'(X)>0 in the other portion thereof. Alternatively, it suffices as long as the value of the change rate L'(X) thereof has a shape of L'(X)<0 from one end to the other end of the aa surface in the X direction or L' (X)=0 in a portion thereof and L'(X)<0 in the other portion thereof. In addition, in the cc surface, it suffices as long as the angle of the side of the cc surface having a generally trapezoidal shape facing in the Z direction (movement direction of the wiper blade 51) is set according to a direction in which ink is not scattered based on a principle that the scattering amount varies.

Figure 18:
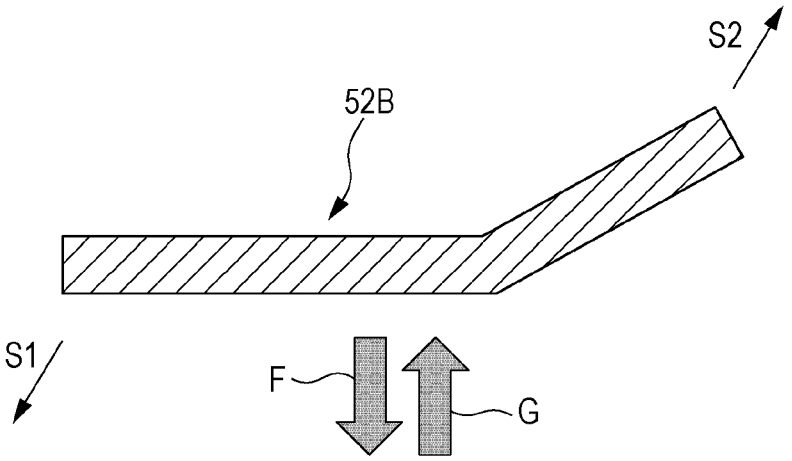
FIG. 18 is a diagram illustrating the shape of the scraping portion in consideration of an ink scattering direction in a forward path and a backward path.
Figure 19:
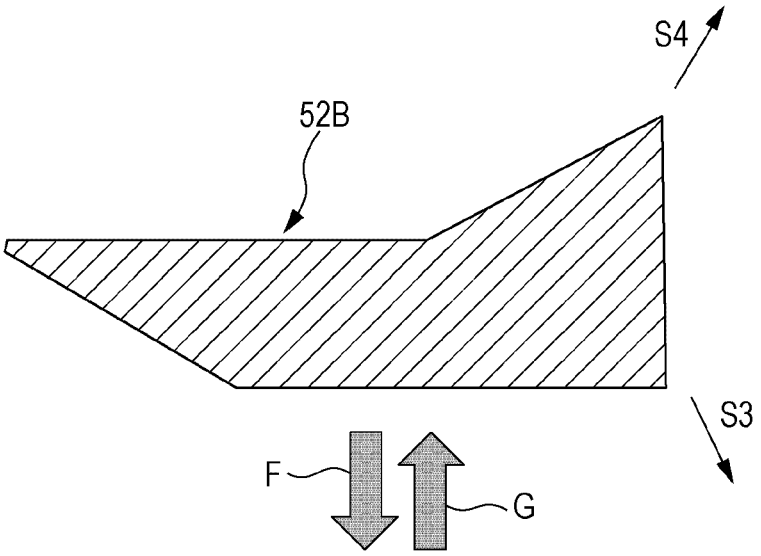
FIG. 19 is a diagram illustrating the shape of the scraping portion in consideration of the ink scattering direction in the forward path and the backward path.

In addition, with respect to the aa surface and the bb surface, the shape of the forward path and the backward path can be set according to the direction in which the ink of the apparatus is not to be scattered. FIG. 18 and FIG. 19 are diagrams illustrating the shape of the scraping portion 52B in consideration of the ink scattering direction in the forward path and in the backward path.

Figure 8:
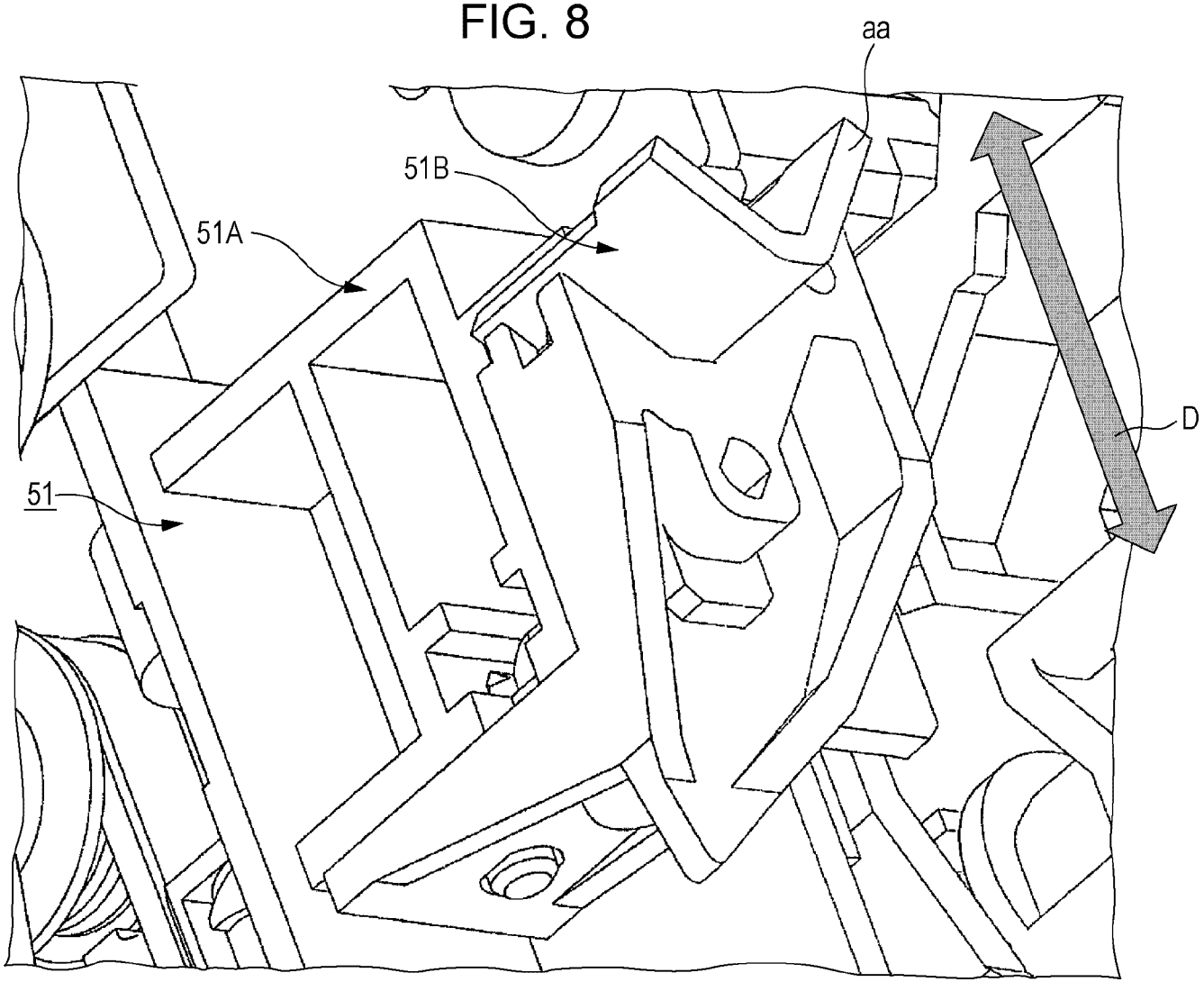
FIG. 8 is a perspective view illustrating the portion of a wiper blade.

FIG. 18 and FIG. 19 illustrate the shape of the bb surface of the scraping portion 52B in a case of the shape of the aa surface of the blade 51B illustrated in FIG. 8 and FIG. 12. In a case illustrated in FIG. 18, due to the action described above, the ink adhering to the blade 51B is scattered in the direction of arrow S1 in the forward path (arrow F in FIG. 18), and is scattered in the direction of arrow S2 in the backward path (arrow G in FIG. 18).

On the other hand, in a case illustrated in FIG. 19, due to the action described above, the ink adhering to the blade 51B is scattered in the direction of arrow S3 in the forward path (arrow F in FIG. 19), and is scattered in the direction of arrow S4 in the backward path (arrow G in FIG. 19).

In FIG. 18, although the ink scattering directions differ in the forward and backward paths in the X direction, the dimension of the scraping portion 52B in the Z direction can be decreased and the movement amount of the wiper blade 51 can be decreased. On the other hand, in FIG. 19, although the dimension of the scraping portion 52B in the Z direction becomes long, the ink scattering direction can be made the same in the forward path and the backward path in the X direction.

As described above, in the printer 1, depending on the shapes of the tip surfaces (aa surface and bb surface) of the blade 51B and the scraping portion 52B of the wiper unit 5 described above, when the blade 51B passes through the scraping portion 52B, the ink scattering direction can be regulated (controlled). Therefore, by appropriately designing the shapes of the aa surface and the bb surface, the region where the ink is not desired to be scattered such as the printing region C can be reliably prevented from ink scattering. Specifically, by setting the shapes of the aa surface and the bb surface to the shapes illustrated in FIG. 8, FIG. 12, and FIG. 18, ink scattering to the printing region C can be prevented and the movement amount of the wiper blade 51 can be decreased.

Accordingly, in the printer 1, the region where ink is not desired to be scattered can be reliably prevented from ink scattering without an increase in size and complexity of the printing apparatus.

In addition, the ink scattering direction in the forward path and the backward path of the wiper blade 51 can be controlled by the shapes of the tip and the rear end in the movement direction on the tip surfaces (aa surface and bb surface) of the blade 51B and scraping portion 52B. Therefore, it can be flexibly applied according to the structure of the apparatus.

In addition, in the printer 1, by appropriately designing the side surface shape (shape of cc surface) of the scraping portion 52B, the ink scattering amount in the forward path and the backward path of the wiper blade 51 can be controlled. Specifically, by adopting the shape illustrated in FIG. 13, the ink scattering amount in the backward path can be decreased and ink scattering to the printing region C can be prevented in the printer 1. Furthermore, in this case, the ink scattering amount increases in the forward path, the ink on the blade 51B can be sufficiently removed, and solidification of the blade 51B can be prevented.

Also in this aspect, in the printer 1, the region where ink is not desired to be scattered can be reliably prevented from ink scattering without an increase in size and complexity of the printing apparatus.

Next, a wiping operation will be described.

Figure 21:
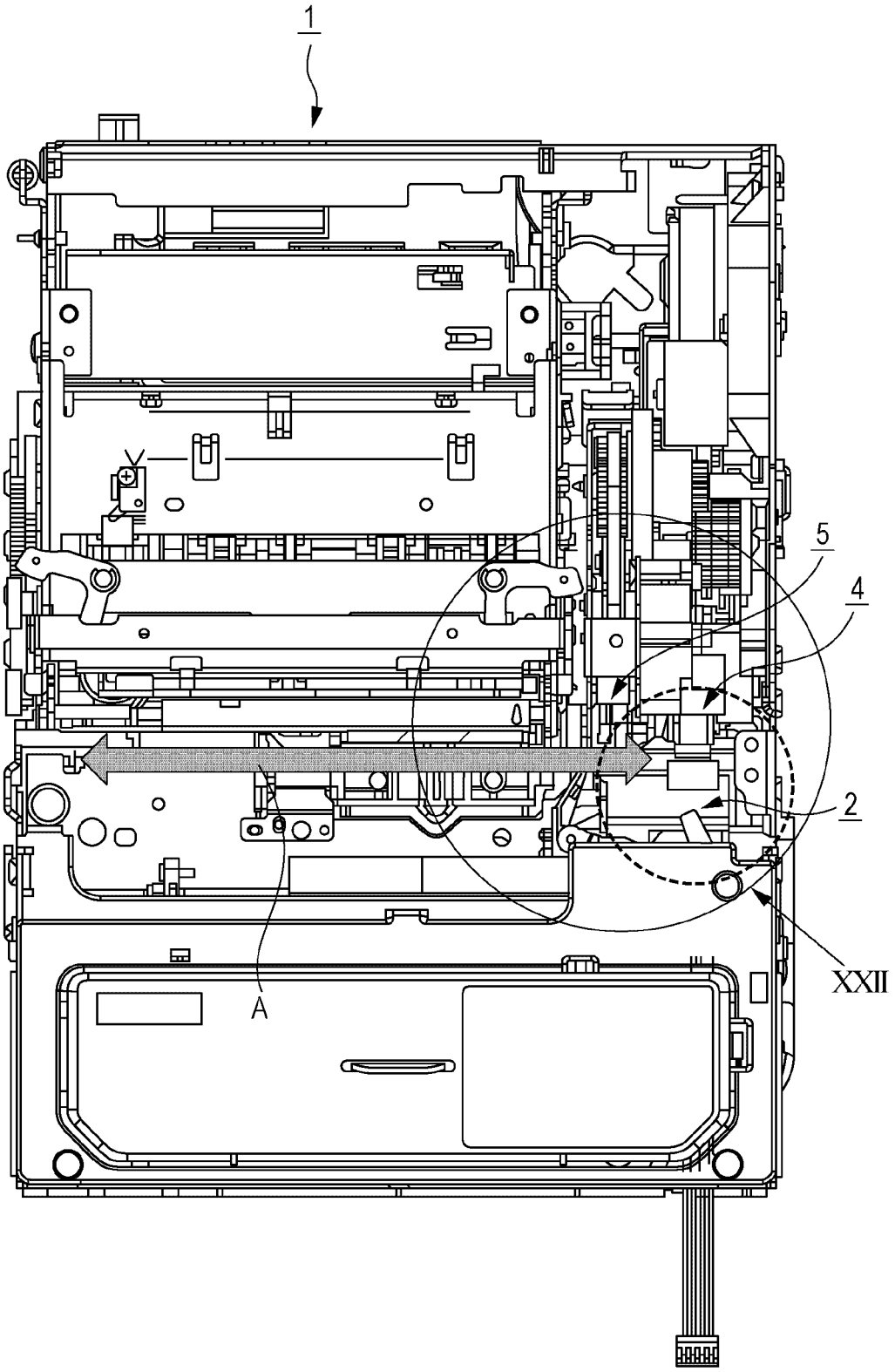
FIG. 21 is a top view of an inside portion of a casing of a printer.
Figure 22:
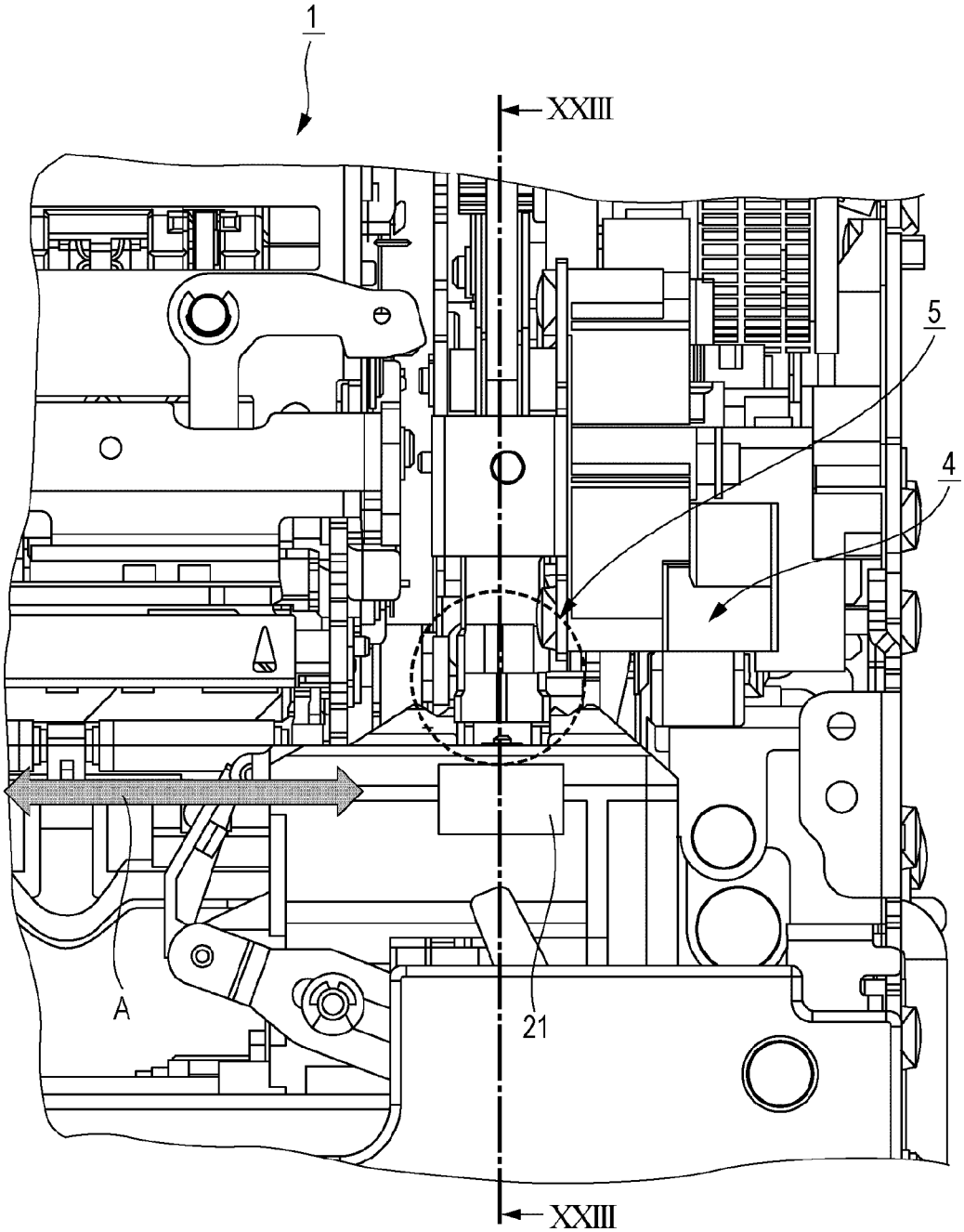
FIG. 22 is a partially enlarged view of FIG. 21 in a case where the carriage is positioned at a wiping position.
Figure 23:
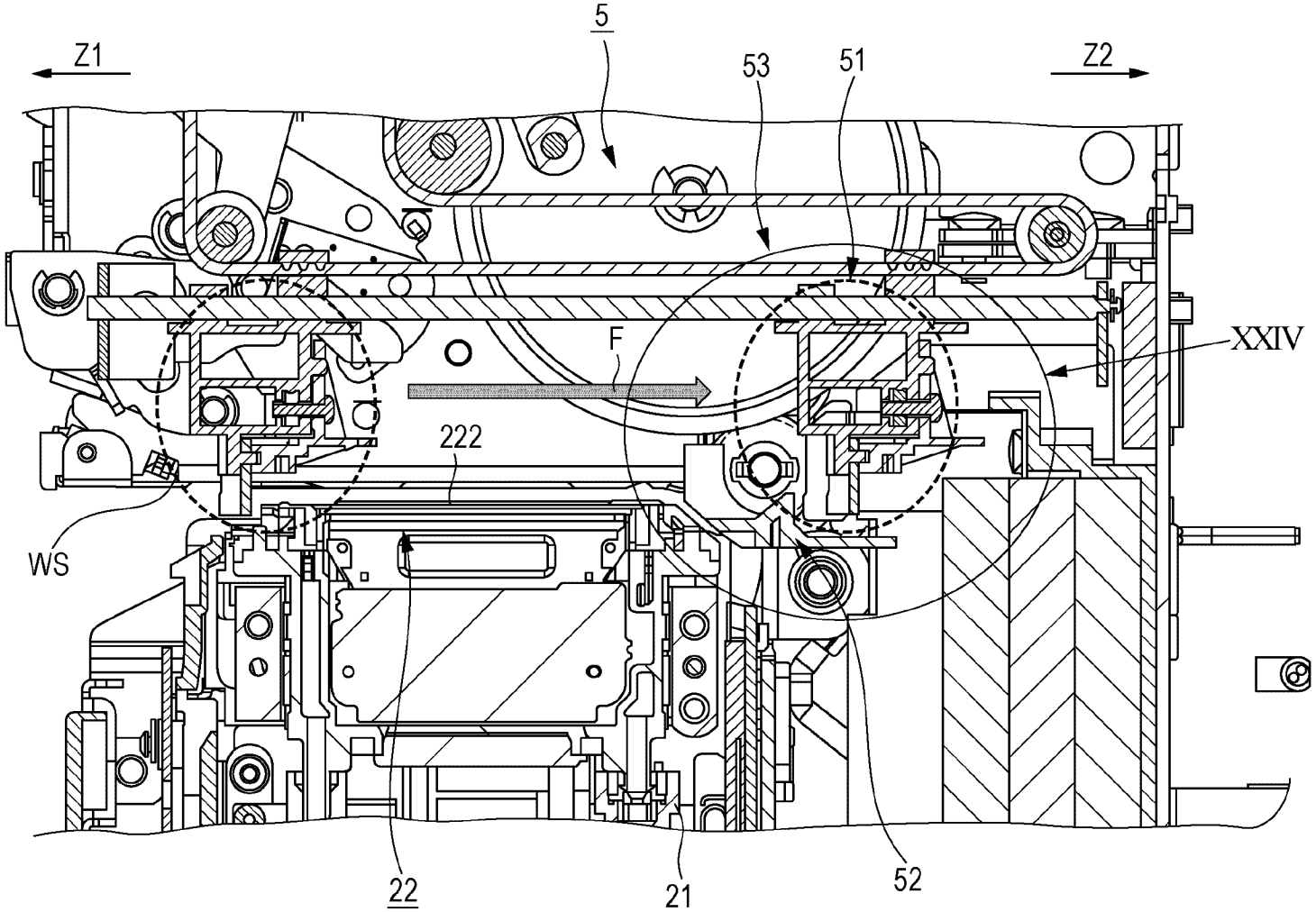
FIG. 23 is a cross-sectional view taken along line XXIII-XXIII of FIG. 22.
Figure 24:
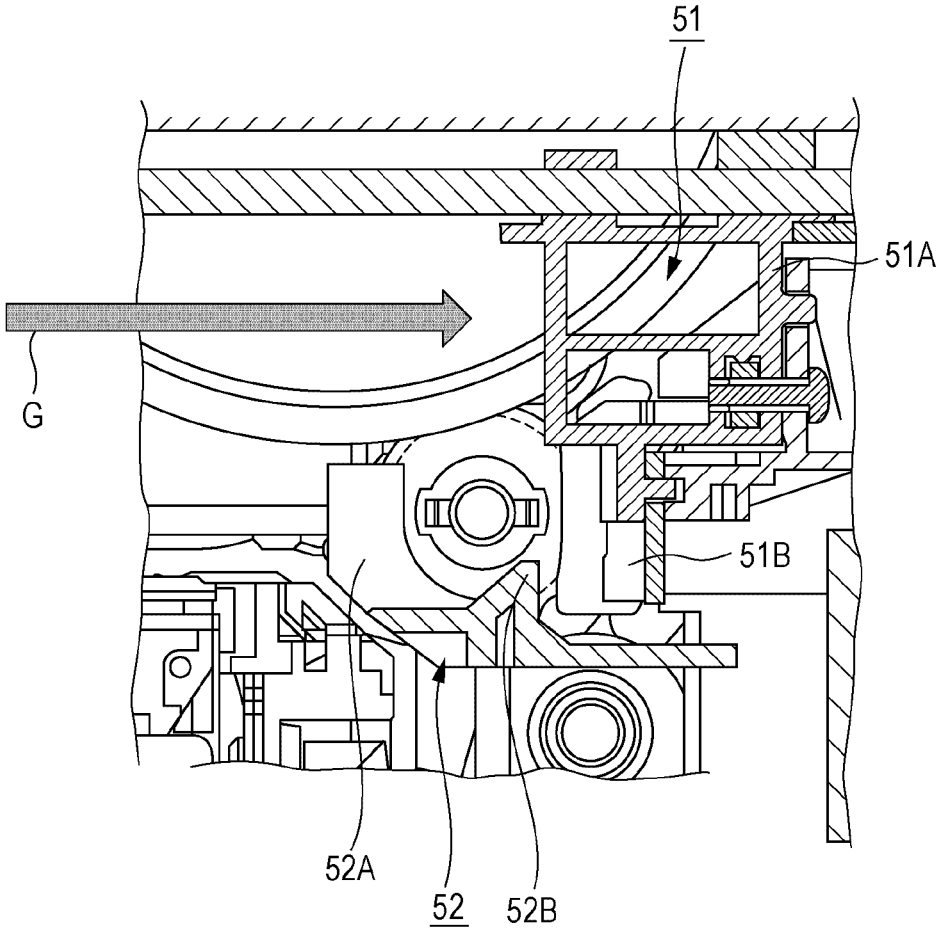
FIG. 24 is a partially enlarged view of FIG. 23.

FIG. 22 is an enlarged view of a portion of XXII in FIG. 21 when the printer 1 in the state of FIG. 1 is viewed from above in the Z direction. In addition, FIG. 23 is a cross-sectional view taken along line XXIII-XXIII of FIG. 22. FIG. 24 is a partially enlarged view of a portion of XXIV in FIG. 23. In FIG. 23, although the wiper blade 51 is illustrated in two places, actually, there is only one wiper blade.

The wiper unit 5 configured as described above performs the wiping operation when the carriage 21 is moved to a wiping position (position of wiper unit 5 in X direction). In other words, the wiping operation is performed at the time of a state illustrated in FIG. 22.

As illustrated in FIG. 23, the wiping operation ends by the wiper blade 51 positioned at the set position WS moving in the direction of arrow F by the driving mechanism 53 and reaching the home position WH. During this movement, the blade 51B abuts on the nozzle surface 222 of the print head 22 and wipes off the ink adhering to the nozzle surface.

FIG. 24 illustrates a state after the wiping operation. Although the wiper blade 51 moved by the wiping operation moves in the direction of arrow G in FIG. 24, after the wiper blade wipes the nozzle surface 222, the wiper blade 51 passes through the cleaner 52 and reaches the position illustrated in FIG. 24, that is, the home position I. When the wiper blade 51 passes through the cleaner 52, since the blade 51B and the scraping portion 52B abuts on each other as described above, the ink wiped off by the blade 51B is scraped off by the scraping portion 52B from the blade 51B. In addition, when the blade 51B abutting the scraping portion 52B and being bent is separated from the scraping portion 52B, the blade 51B returns to original shape thereof and the ink remaining on the blade 51B is scattered from the blade 51B by the vibration (amplitude) at that time.

Figure 25:
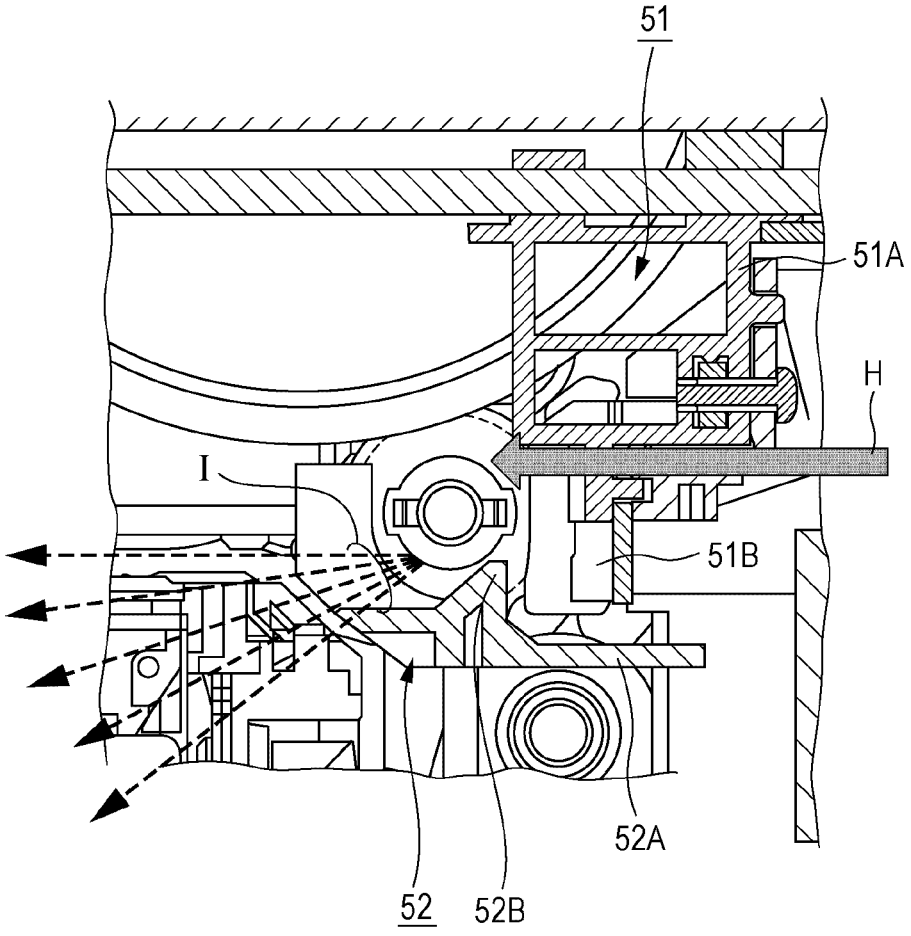
FIG. 25 is a view for illustrating the ink scattering direction.
Figure 26:
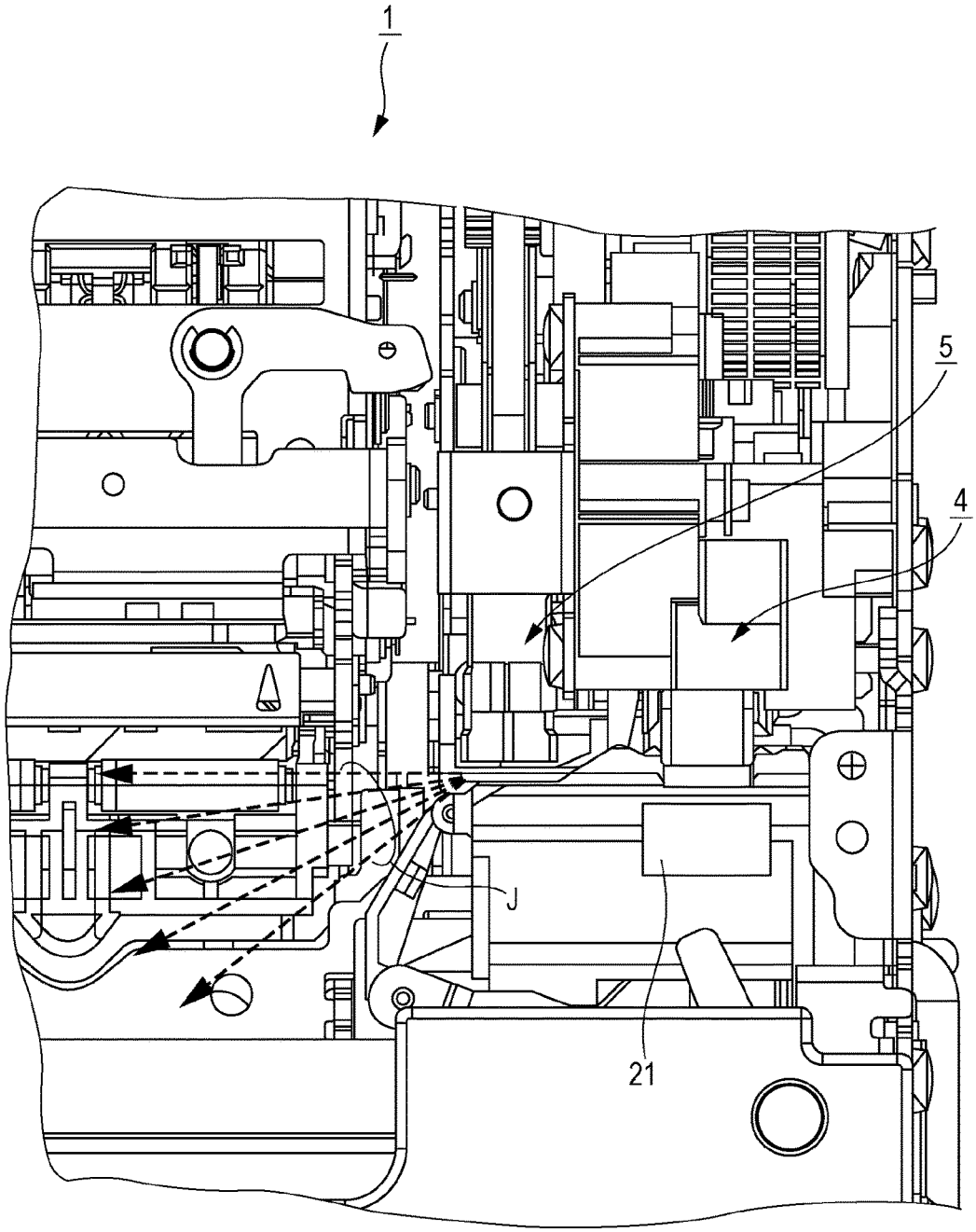
FIG. 26 is a view for illustrating the ink scattering direction.

In addition, even when the wiper blade 51 at the home position is moved to the set position, the wiper blade 51 passes through the cleaner 52. At that time, similarly, ink is scraped off and scattered from the blade 51B. FIG. 25 and FIG. 26 are views for illustrating the ink scattering direction at that time. FIG. 25 is a view viewed from the same direction as FIG. 24 and FIG. 26 is a view as viewed from the same direction as FIG. 22.

When the wiper blade 51 moves from the home position to the set position, the wiper blade 51 moves from the state illustrated in FIG. 25 in the direction of arrow H in FIG. 25 and passes through the cleaner 52. At the time of the passage thereof, similarly to after the wiping operation, the blade 51B abuts on the scraping portion 52B and then separates from the scraping portion 52B. When the blade B is separated from the scraping portion, due to the vibration of the blade 51B, there is a possibility that the splash of the ink flies in a direction indicated by dotted arrow I in FIG. 25 and the direction indicated by dotted arrow J in FIG. 26. FIG. 26 illustrates a case where the carriage 21 is at the home position, in a case where the carriage 21 is on an away side, there is a possibility that the ink is scattered on the right side (X1 direction) in FIG. 26.

Figure 27:
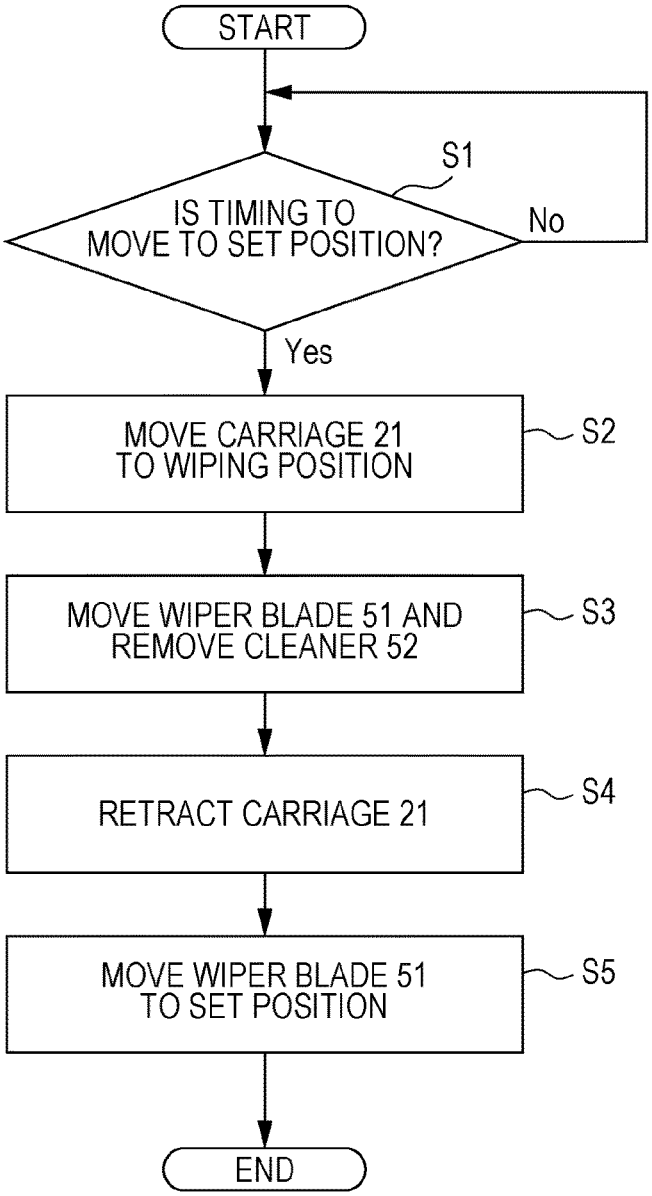
FIG. 27 is a flowchart illustrating a control procedure when the wiper blade is moved from a home position to a set position.

The printer 1 is characterized by control when the wiper blade 51 moves to the set position side, particularly when the wiper blade passes through the cleaner 52, and hereinafter, contents thereof will be described. FIG. 27 is a flowchart illustrating a control procedure when the wiper blade 51 is moved from the home position to the set position. The control illustrated in FIG. 27 is performed by a control portion (not illustrated) of the printer 1.

First, the control portion waits until it becomes the timing to move the wiper blade 51 to the set position (No in step S1 of FIG. 27). When it becomes the timing to perform the wiping operation, such as after the completion of the ink suction by the cap unit 4, the control portion determines that it is the timing to move the wiper blade 51 to the set position (Yes in step S1 in FIG. 27), the carriage 21 moves to the wiping position (step S2 in FIG. 27).

Thereafter, the control portion moves the wiper blade 51 from the home position and passes through the cleaner 52 (step S3 in FIG. 27). Specifically, when the driving mechanism 53 is activated and the wiper blade 51 passes through the cleaner 52 and then reaches a position before the carriage 21, the driving mechanism 53 is stopped and the wiper blade 51 is stopped at that position.

Next, the control portion retracts the carriage 21 from the wiping position (step S4 in FIG. 27). Specifically, the carriage 21 is moved to the home side or the away side of the carriage 21 in the movement direction (X direction) so that when the wiper blade 51 moves to the set position, the blade 51B is retracted to a position which does not abut the nozzle surface 222.

Thereafter, the control portion moves the wiper blade 51 to the set position (step S5 in FIG. 27). Specifically, the driving mechanism 53 is activated to move the wiper blade 51 and when the wiper blade 51 reaches the set position, the driving mechanism 53 is stopped and the wiper blade 51 is stopped at that position.

Figure 28:
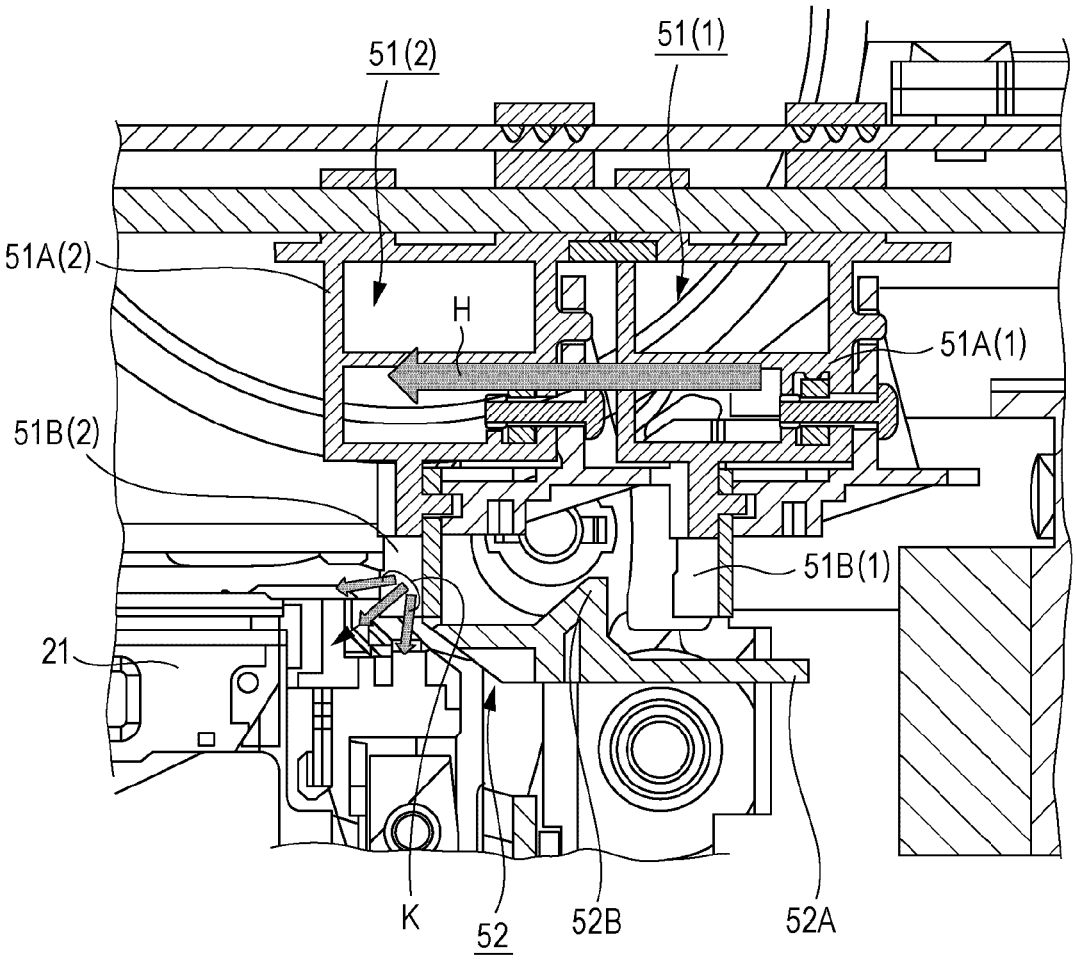
FIG. 28 is a view for illustrating an ink scattering state when the wiper blade passes through the cleaner.

As described above, when the wiper blade 51 is moved to the set position and the wiper blade 51 passes through the cleaner 52, the carriage 21 is positioned at the wiping position. FIG. 28 is a view for illustrating an ink scattering state when the wiper blade 51 passes through the cleaner 52. In FIG. 28, although the wiper blade 51 is illustrated in two places, actually, there is only one wiper blade.

In FIG. 28, the wiper blade 51 (1) illustrates the wiper blade at the home position and the wiper blade 51 (2) illustrates the wiper blade after passing through the cleaner 52. As described above, when the wiper blade 51 moves in the direction of arrow H in FIG. 28 and passes through (leaves) the cleaner 52, the ink remaining on the blade 51B is scattered.

However, in this passing operation, in the printer 1, as described above, the carriage 21 is positioned at the wiping position and covers the substantially upper side (Z1 direction side) of the wiper blade 51 at a short distance. Accordingly, the ink scattered from the blade 51B (2) hits the carriage 21 as illustrated by arrow K in FIG. 28 and is not scattered to other portions. Particularly, entry of splashes into the transport path of the print medium and the printing region C positioned on the X2 direction side of the wiper blade 51 (2) in the Z1 direction is prevented. In addition, the ink hitting the carriage 21 is positioned at the front surface (tip surface in Y2 direction) of the carriage 21 and is absorbed by the absorbing material 211 (see FIG. 20) provided at positions on both sides of the print head 22 in the X direction.

In a case where ink is sucked and wiped by the printer 1, since the control portion first moves the wiper blade 51 at the home position to the set position, as described with reference to FIG. 27, the control portion moves the carriage 21 to the wiping position and moves to the position where the wiper blade 51 passes through the cleaner 52. Thereafter, the control portion retracts the carriage 21 from the wiping position and moves the wiper blade 51 to the set position. Next, the control portion moves the carriage 21 to the position of the cap unit 4 and causes the cap unit 4 to perform ink suction operation. Thereafter, the control portion moves the carriage 21 to the wiping position, moves the wiper blade 51 from the set position to the home position, and wipes the ink on the nozzle surface 222.

In a case of an apparatus in which the movement of the wiper blade 51 is performed by the same driving source (motor or the like) as the suction pump or the like of the cap unit 4, in addition to when the wiper blade 51 is moved to the set position, the wiper blade 51 may need to move in a direction in which the wiper blade 51 passes through the cleaner 52. For example, in a case where the suction pump is rotated in the reverse direction, there is a case where the suction pump is initialized, or the like. Also in this case, similarly, the control portion controls the wiper blade 51 to move after the carriage 21 is moved to the wiping position.

In addition, although the carriage 21 is moved to the wiping position when the wiper blade 51 is moved so that the wiper blade 51 passes through the cleaner 52 in the above description, instead of accurately moving the wiper blade 51 to the wiping position, the carriage may be moved to an appropriate position that can cover the wiper blade 51. For example, in a case where the ink scattering direction is defined in a predetermined fixed direction by the shapes of the blade 51B, the scraping portion 52B, and the like, the carriage 21 is moved to a position for covering the direction thereof. In addition, for example, the carriage 21 is moved so as to cover a direction of a portion (for example, printing region C or the like) where ink scattering is particularly desired to be prevented.

As described above, in the printer 1, when (before) the wiper blade 51 passes the cleaner 52 in the Z1 direction (upward), the carriage 21 moves to a predetermined position (for example, wiping position) covering a periphery of the wiper blade 51. Therefore, when the wiper blade 51 passes through the cleaner 52, the blade 51B vibrates and the ink scattered from the blade 51B is received by the carriage 21 at a short distance and disordered ink scattering can be prevented. Accordingly, adhering of ink splash to the transport mechanism 3 (transport roller and the like) can be prevented so as not to contaminate printed matter or other portions in the apparatus. In addition, the operation load by thickening of the flying ink is not increased. Further, such an effect can be obtained without providing a new mechanism, and complexity of the apparatus and an increase in manufacturing cost are not generated.

In addition, the invention is suitable for a small-sized printing apparatus in which the operating path of the wiper blade 51 and the transport path of the print medium have to be disposed close to each other like the printer 1.

In addition, by setting the predetermined position for moving the carriage 21 to the wiping position, it is possible to effectively prevent the wiper blade 51 and the carriage 21 from approaching to each other to the maximum and scattering the ink to other portions and there is no need to create a new stop position of the carriage 21.

In addition, by setting the predetermined position for moving the carriage 21 to a position covering the ink scattering direction from the blade 51B, ink scattering to the other portion can be reliably prevented.

In addition, by setting the predetermined position for moving the carriage 21 to the position of the blade 51B on the printing region C side in the scanning direction (X direction), ink scattering to the printing region C can be prevented.

Further, the absorbing material 211 is attached to the wiper blade 51 side of the carriage 21 and since the absorbing material 211 absorbs the receiving ink, transfer of the ink to other portions can be prevented.

The protection scope of the invention is not limited to the above embodiment but extends to the invention described in the claims and equivalents thereof.

The entire disclosure of Japanese Patent Application No. 2016-206823, filed Oct. 21, 2016 and No. 2016-206822, filed Oct. 21, 2016 are expressly incorporated by reference herein.

What is claimed is:

1. A printing apparatus which performs printing by ejecting ink from a nozzle, comprising:

a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, wherein the wiper blade includes a blade member which protrudes in a second direction which is substantially orthogonal to the first direction, wherein the cleaner includes a scraping member which protrudes in a third direction which is a direction opposite to the second direction, and wherein shapes of a tip surface of the blade member in the second direction and a tip surface of the scraping member in the third direction are formed so that the blade member is sequentially separated from the scraping member from one end toward the other end thereof in a fourth direction which is substantially orthogonal to the first direction in the tip surface thereof when the wiper blade abuts on the cleaner and passes through the cleaner.

2. The printing apparatus according to claim 1, wherein the tip surface of the blade member includes two inclined portions which are positioned at both ends thereof in the fourth direction and a horizontal portion which connects the inclined portions to each other and extends substantially along the fourth direction, wherein the tip surface of the scraping member includes one inclined portion which is positioned from one end in the fourth direction and a horizontal portion which connects the inclined portion and the other end in the fourth direction to each other and extends substantially along the fourth direction, and wherein one of the inclined portions of the blade member and the inclined portion of the scraping member are disposed at substantially the same position in the first direction, and inclination angles of the two inclined portions of the blade member with respect to the fourth direction are less than an inclination angle of the inclined portion of the scraping member with respect to the fourth direction.

3. A printing apparatus which performs printing by ejecting ink from a nozzle, comprising:

a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, wherein the wiper blade includes a blade member which protrudes in a second direction which is substantially orthogonal to the first direction, wherein the cleaner includes a scraping member which protrudes in a third direction which is a direction opposite to the second direction, and wherein shapes of a tip surface of the blade member in the second direction and a tip surface of the scraping member in the third direction are formed so that a separation distance between the blade member and the scraping member in the first direction increases without decreasing or decreases without increasing from one end toward the other end thereof in a fourth direction which is substantially orthogonal to the first direction in the tip surface of the blade member.

4. A printing apparatus which performs printing by ejecting ink from a nozzle, comprising:

a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, wherein the cleaner includes a scraping member which protrudes in a direction which substantially is orthogonal to the first direction, and wherein inclination angles of a front and rear surfaces of the scraping member in the first direction with respect to a surface substantially orthogonal to a direction in which the scraping member protrudes are different from each other.

5. The printing apparatus according to claim 4, wherein the inclination angle in the first direction which is the inclination angle of the front surface of the scraping member is larger than the inclination angle in the first direction which is the inclination angle of the rear surface of the scraping member.

6. A printing apparatus which performs printing by ejecting ink from a nozzle, comprising:

a wiper blade that abuts on a nozzle surface on which an opening of the nozzle is formed, and moves in a first direction to wipe the ink adhering to the nozzle surface; and a cleaner that abuts on the moving wiper blade and scrapes off the ink adhering to the wiper blade, wherein the wiper blade includes a blade member which protrudes in a second direction which is substantially orthogonal to the first direction, wherein the cleaner includes a scraping member which protrudes in a third direction which is a direction opposite to the second direction, and wherein a front and rear surfaces of the scraping member in the first direction are formed so that the positions thereof in the third direction at which the blade member is separated from the scraping member are different from each other with respect to on a passing direction when the wiper blade abuts on the cleaner and passes through the cleaner.

* * * * *